US005545862A

United States Patent [19]

Takano et al.

[11] Patent Number: 5,545,862

[45] Date of Patent: Aug. 13, 1996

[54] SLIDE SWITCH

[75] Inventors: Tsunesuke Takano; Kouichi Sinzawa, both of Tokyo, Japan

[73] Assignee: Kabushiki Kaisha T an T, Japan

[21] Appl. No.: 314,500

[22] Filed: Sep. 28, 1994

[30] Foreign Application Priority Data

| | | | |
|---|---|---|---|
| Oct. 18, 1993 | [JP] | Japan | 5-284002 |
| Nov. 1, 1993 | [JP] | Japan | 5-296134 |
| Jul. 5, 1994 | [JP] | Japan | 6-175923 |

[51] Int. Cl.[6] ..... H01H 15/00

[52] U.S. Cl. ..... 200/16 R; 200/16 C; 439/79

[58] Field of Search ..... 200/16 R, 16 F, 200/16 C, 16 D, 16 A, 16 B, 16 E, 51 R, 51.09, 51.1; 439/79

[56] References Cited

U.S. PATENT DOCUMENTS

| | | | |
|---|---|---|---|
| 4,256,935 | 3/1981 | Ito et al. | 200/51 R |
| 4,393,283 | 7/1983 | Masuda | 200/51.09 |
| 4,885,438 | 12/1989 | Tajima | 200/51.09 |
| 5,043,540 | 8/1971 | Takano | 200/16 C |
| 5,145,385 | 9/1992 | Takano | 439/79 |
| 5,345,372 | 9/1994 | Takano et al. | 200/16 C X |
| 5,365,028 | 11/1994 | Takano | 200/16 R |
| 5,378,863 | 1/1995 | Sekita | 200/16 R |

FOREIGN PATENT DOCUMENTS

| | | | |
|---|---|---|---|
| 52-57278 | 10/1975 | Japan | H01H 15/16 |
| 2-276117 | 11/1990 | Japan | H01H 1/58 |
| 3-8833 | 1/1991 | Japan | H01H 15/10 |
| 3-29221 | 2/1991 | Japan | H01H 11/00 |

*Primary Examiner*—J. R. Scott
*Attorney, Agent, or Firm*—Nixon & Vanderhye P.C.

[57] ABSTRACT

The object of the present invention is to enable a power source line and load to be connected in a single operation via a plug-in jack by operating a switch, and reliably support the bases of plugs while protecting the plugs with a plug cover formed into a single structure with a switch cover. In the present invention, a slide switch is described comprising: a knob facing to the outside from a slot continuous with a recess of an insulating base, movably providing a sliding body within the above-mentioned recess of the above-mentioned insulating base, arranging in parallel a plurality of fixed contacts that make sliding contact with a movable contact resiliently provided on the sliding body by means of a resilient spring, and covering its outside surface with an insulating plate; wherein, at least one of the above-mentioned fixed contacts is bent to compose a plug, and a guiding member, which guides the insertion of a plug-in jack J that attaches to the plugs, is formed into a single structure with the above-mentioned insulating plate.

15 Claims, 46 Drawing Sheets

SLIDE SWITCH

FIELD OF THE INVENTION

The present invention relates generally to slide switches with fixed contacts that may usefully be employed in automotive interior lamps and the like, and to improvements in external connecting devices for such slide switches.

BACKGROUND OF THE INVENTION

One example of a conventional slide switch is described in Japanese Utility Model Laid-Open Patent Publication No. 3-8833. In this regard, the slide switch of this Japanese Utility Model is equipped with a movable contact for the sliding body. A slot continuous with the insulating base is provided and has a generally U-shaped cross-section to allow a knob to project outwardly through the slot. An insulated sliding body is movably equipped within a recess of the insulating base. A movable contact having a roughly U-shaped cross-section and a locking portion is insertably locked in a locking hole in such a manner that a resilient spring is juxtaposed between the upper surface of the movable contact and the sliding body. An insulating plate is provided with a plurality of fixed contacts. The movable contact thereby makes sliding contact with the fixed contacts of the insulating plate by straddling the movable contact on the lower portion of said insulating base.

Since a wiring harness must be wired directly to a power source or other circuit portions on the insulating base, there are considerable restrictions on the locations where it can be applied when using the conventional slide switch described above. In addition, since the lead portion of the fixed contact is exposed, it is susceptible to accidents resulting from contact with other members. Moreover, since it is also necessary to maintain the exposed portion of the fixed contact in an insulated state and reliably support it to prevent accidents caused by mutual shorting, the prior art has numerous disadvantages in the form of being bothersome and expensive.

SUMMARY OF THE INVENTION

According to the present invention, a slide switch is provided which is capable of being connected to a power source line and a load in a single operation via a plug-in jack. In addition, the plugs are protected by a plug cover formed integrally with a switch cover plate.

More particularly, the slide switch of this invention includes an electrically insulating housing defining a recess and an elongate slot which opens into the recess. A slide body is received within the housing recess so as to be slidably movable therewithin between at least first and second positions. The slide body includes a knob which protrudes outwardly from the housing through the defined slot so as to be moved manually from one end of the slot to another end and thereby slidably move the slide body between at least first and second positions. A movable electrical contact is also provided on the slide body so as to be movable therewith between its first and second positions. A plurality of parallel fixed contacts extend substantially transverse to and across the slot. As such, the movable electrical contact of the slide body makes electrical contact with at least one of said fixed contacts when said slide body is moved into at least one of its first and second positions.

Important to the present invention, an electrically insulating cover plate is attached to the housing in covering relationship to the recess so as to thereby cover the slide body and the fixed contacts. The cover plate integrally includes an open ended guide housing member which defines an interior space. At least one of the fixed contacts is provided with an end bent to form a contact plug which projects into said interior space of the guide housing member so as to be connectable to a plug-in jack inserted into said open end of said housing member.

These and other aspects and advantages of the present invention will become more clear after careful consideration is given to the following detailed description of the preferred exemplary embodiments thereof.

BRIEF DESCRIPTION OF THE ACCOMPANYING DRAWINGS

Figure 16:
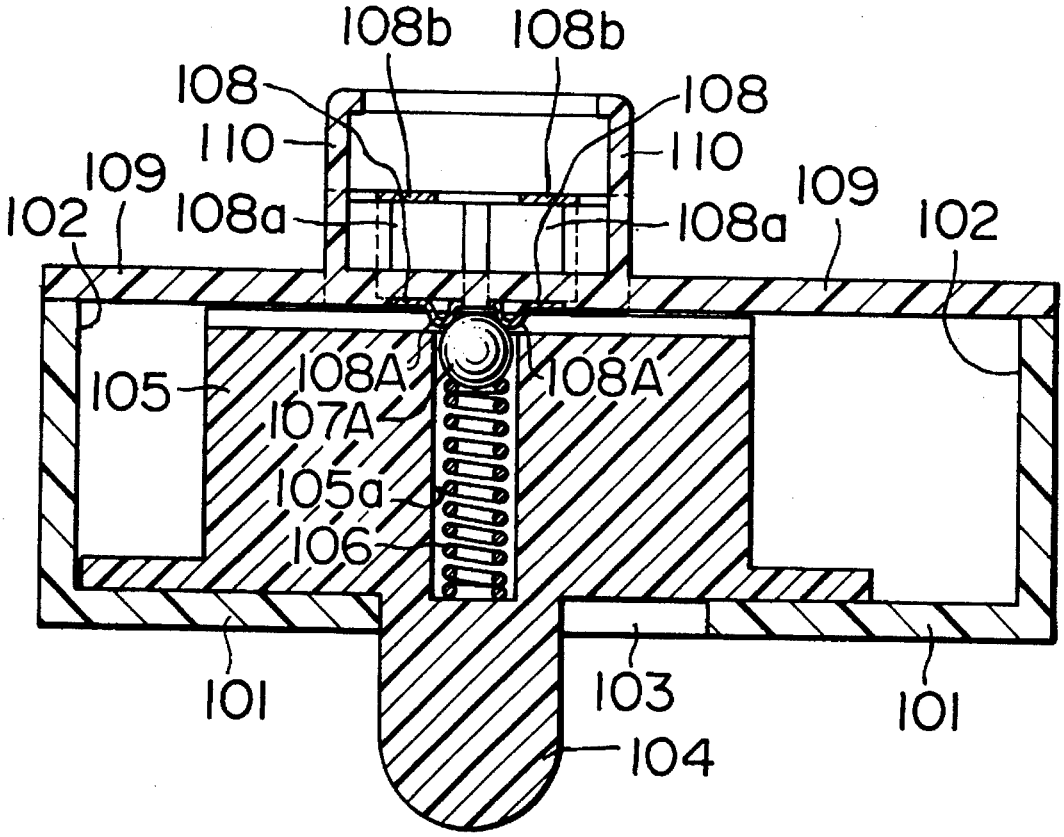
Figure 17:
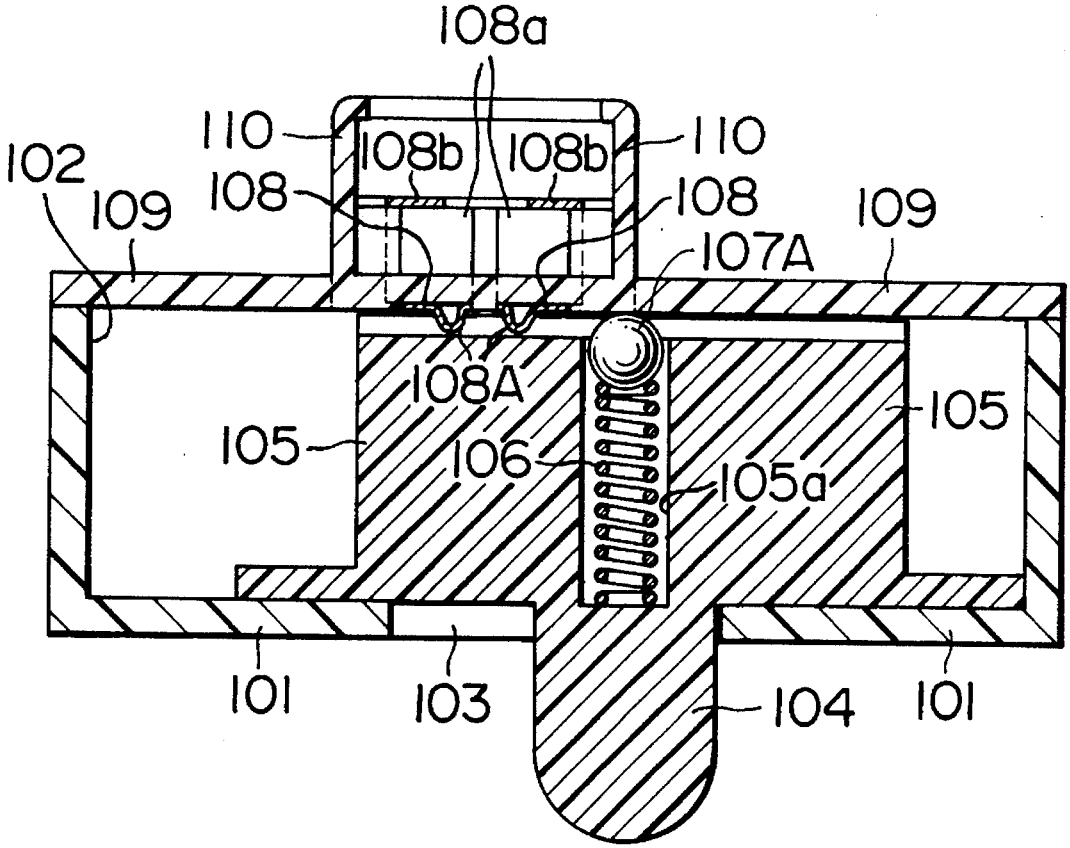
Figure 18:
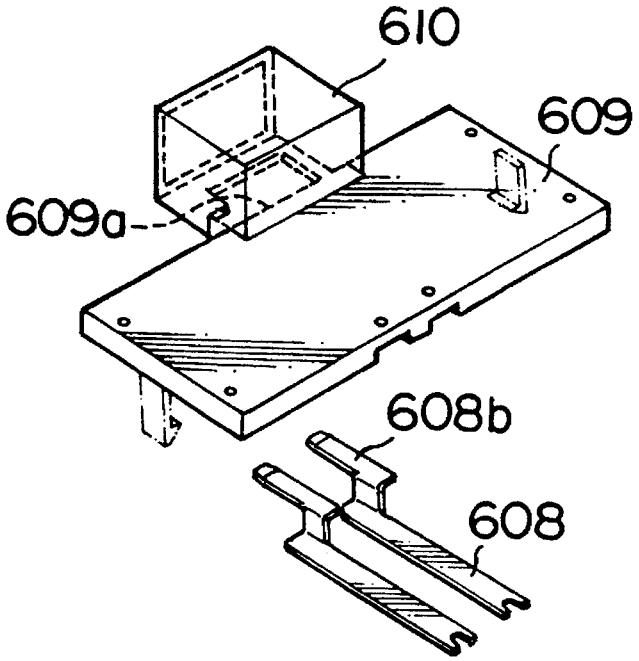
Figure 18:
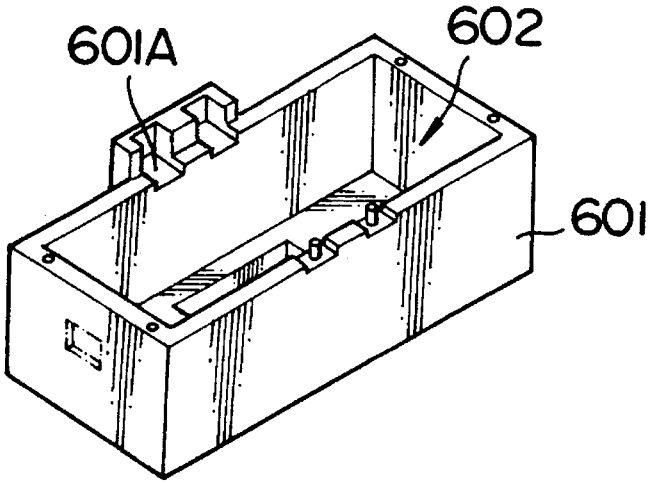
Figure 19:
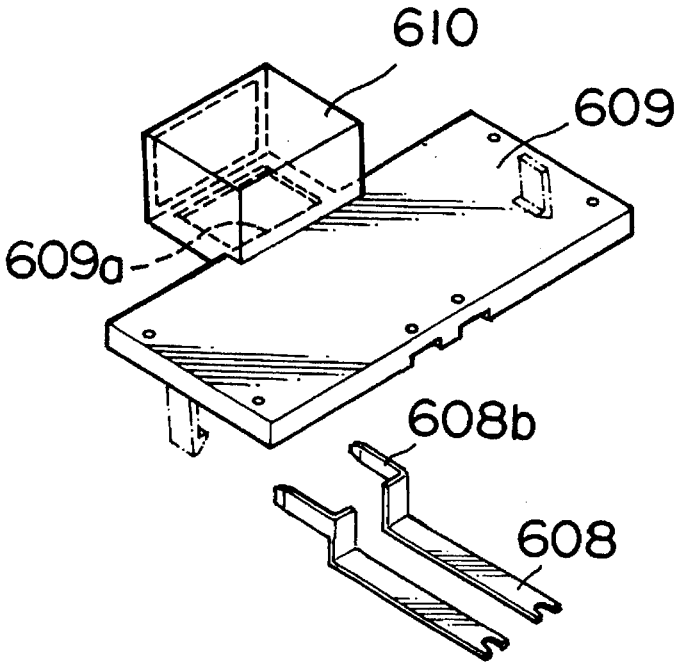
Figure 19:
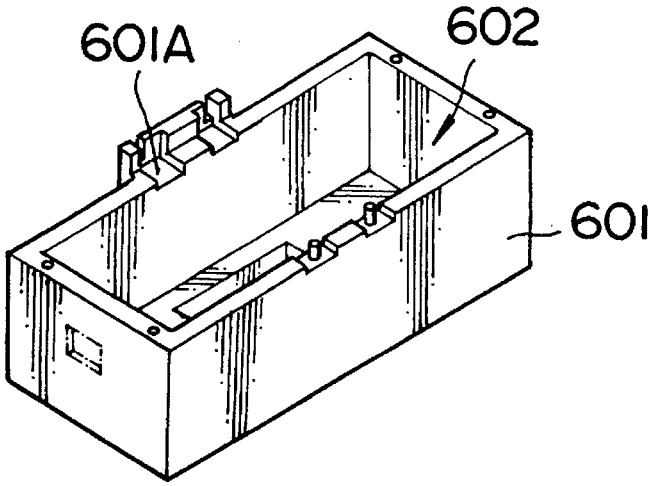
Figure 20:
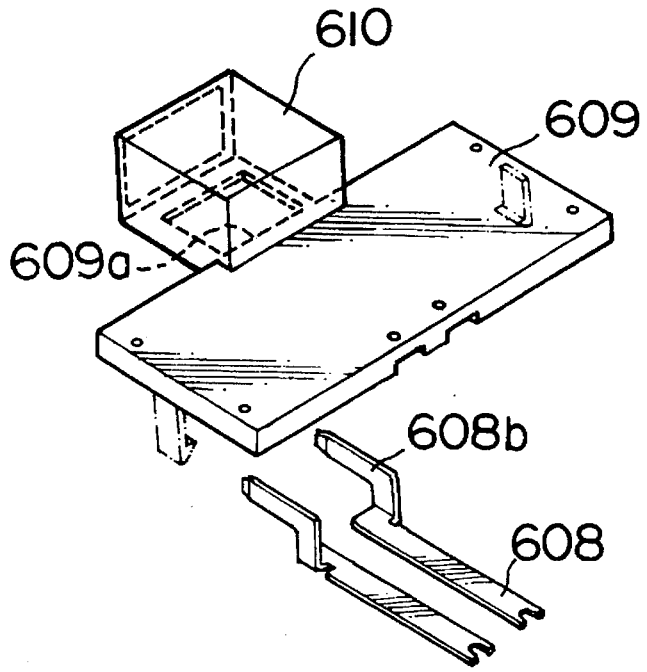
Figure 20:
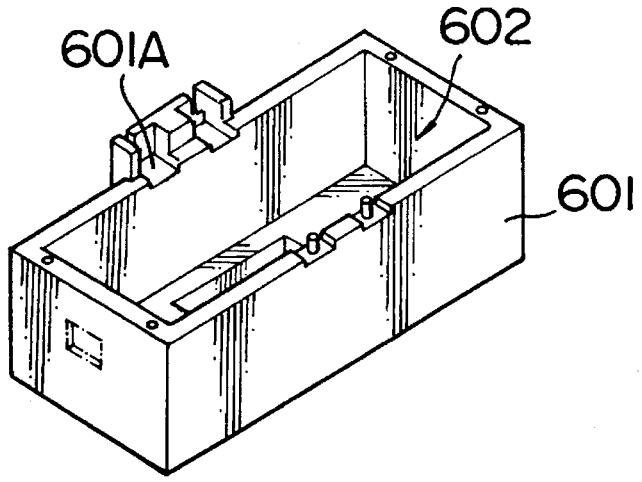
Figure 21:
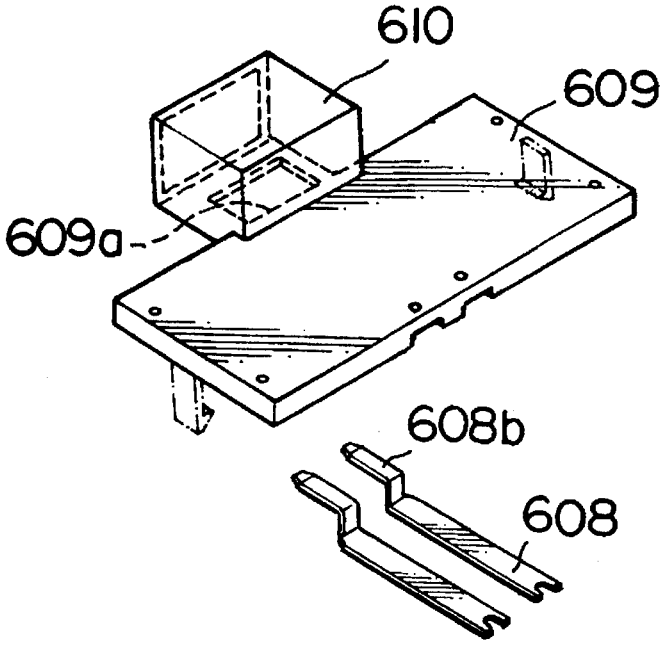
Figure 21:
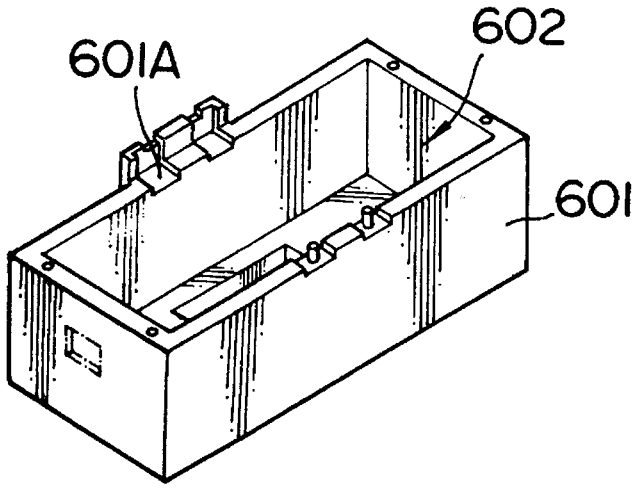
Figure 22:
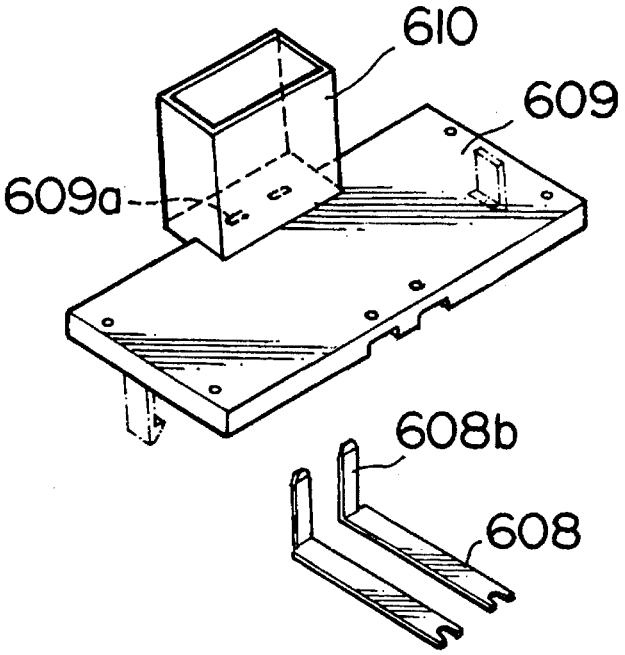
Figure 22:
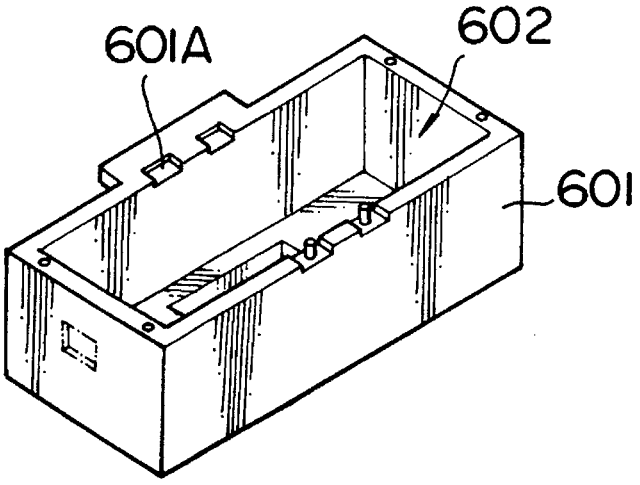
Figure 23:
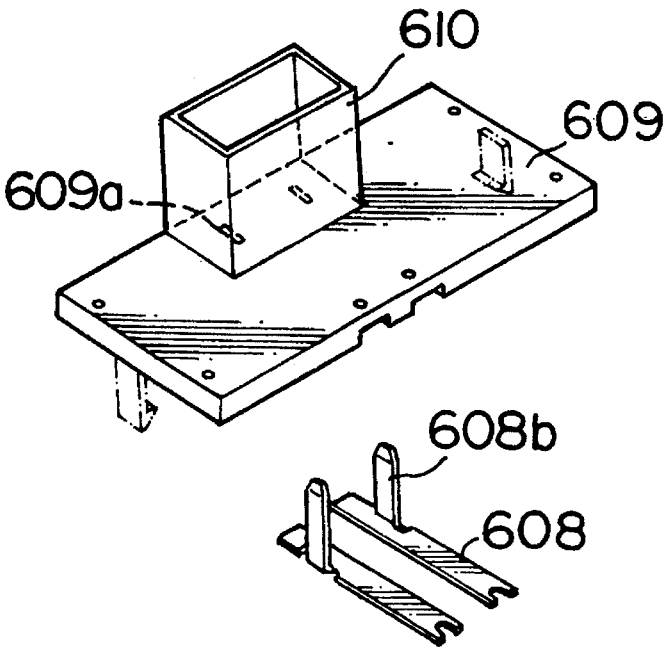
Figure 23:
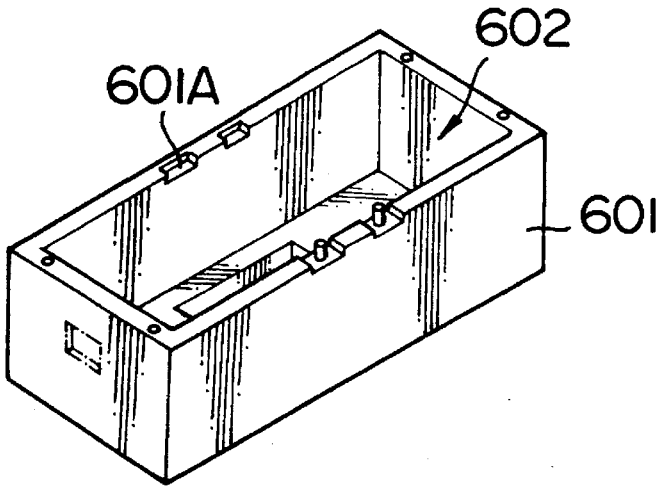
Figure 24:
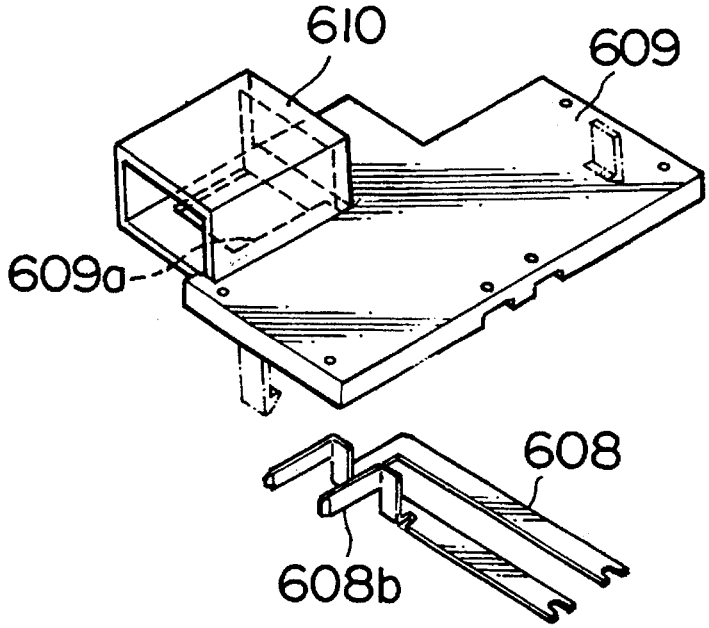
Figure 24:
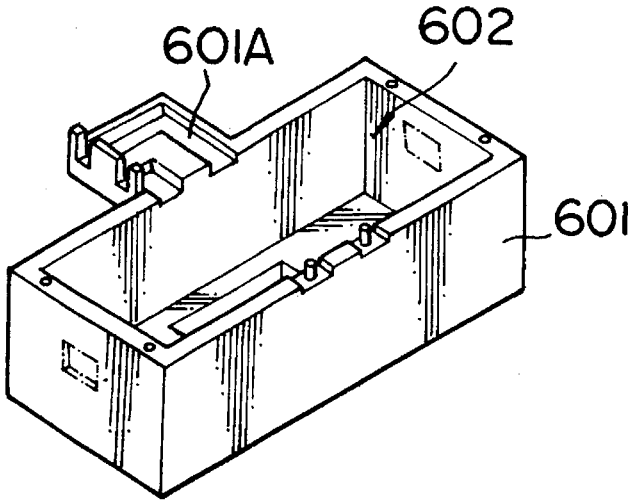
Figure 25:
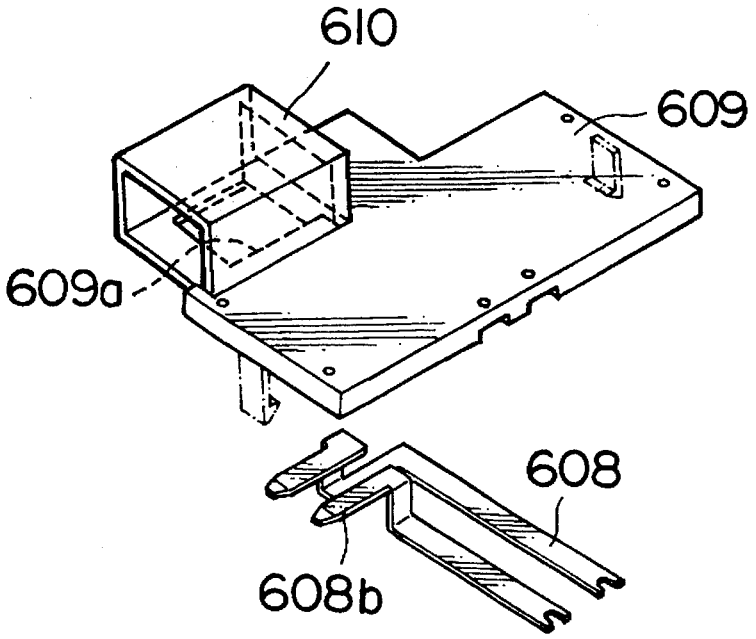
Figure 25:
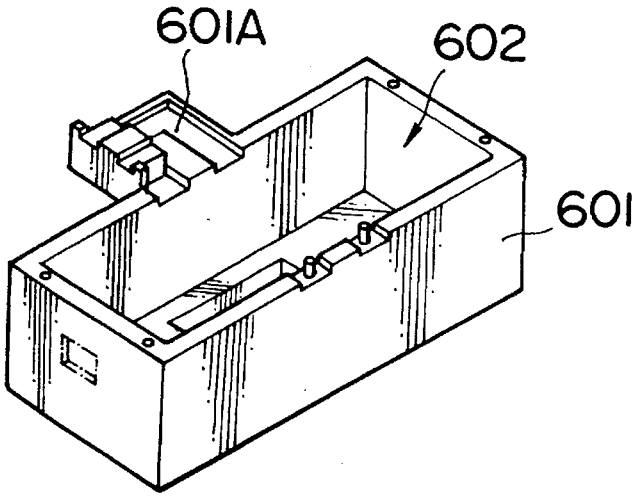
Figure 26:
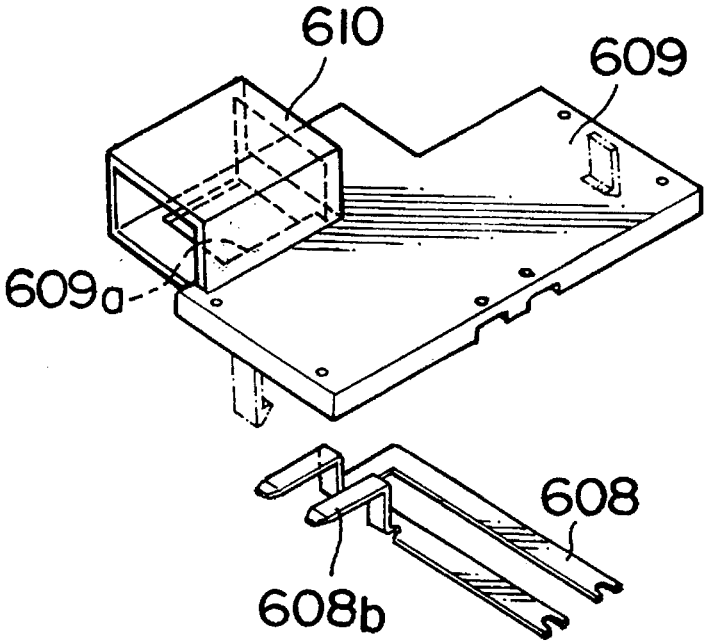
Figure 26:
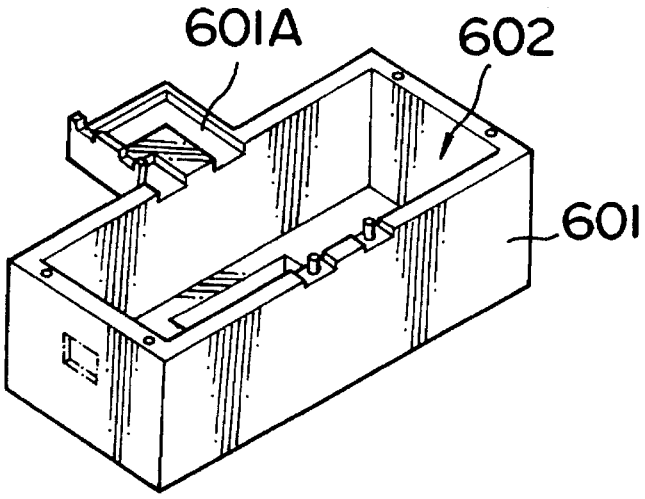
Figure 27:
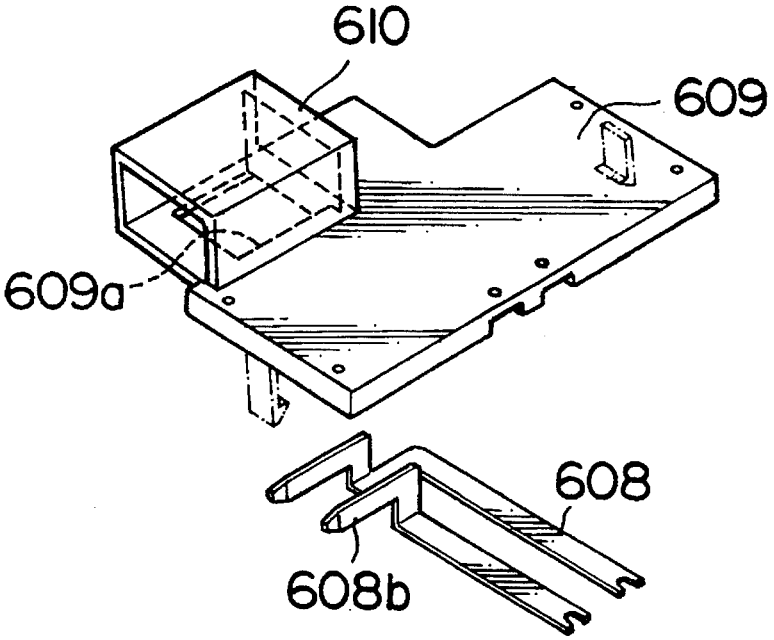
Figure 27:
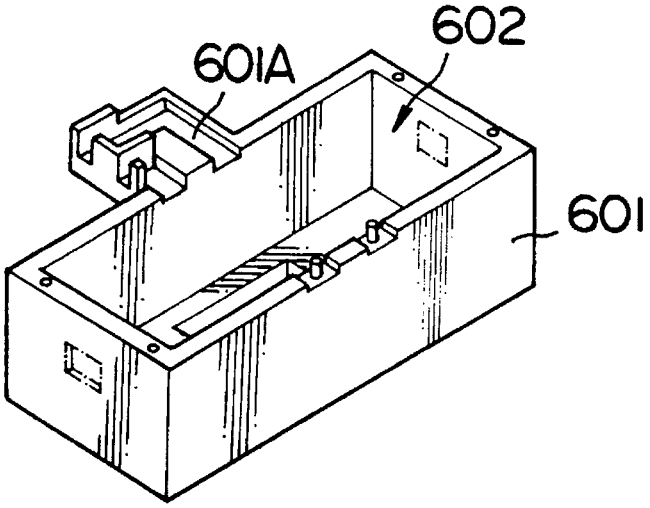

FIG. 16 longitudinal cross-sectional view showing an example of use of another embodiment of the present invention;

FIG. 17 is a longitudinal cross-sectional view of a different state of that shown in FIG. 16;

FIG. 18 is exploded perspective views of the essential portions of other applied embodiments of the present invention;

FIG. 19 is exploded perspective views of the essential portions of other applied embodiments of the present invention;

FIG. 20 is exploded perspective views of the essential portions of other applied embodiments of the present invention;

FIG. 21 is exploded perspective views of the essential portions of other applied embodiments of the present invention;

FIG. 22 is exploded perspective views of the essential portions of other applied embodiments of the present invention;

FIG. 23 is exploded perspective views of the essential portions of other applied embodiments of the present invention;

FIG. 24 is exploded perspective views of the essential portions of other applied embodiments of the present invention;

FIG. 25 is exploded perspective views of the essential portions of other applied embodiments of the present invention;

FIG. 26 is exploded perspective views of the essential portions of other applied embodiments of the present invention; and FIG. 27 is exploded perspective views of the essential portions of other applied embodiments of the present invention.

DETAILED DESCRIPTION OF THE PREFERRED EXEMPLARY EMBODIMENT

Figure 1A:
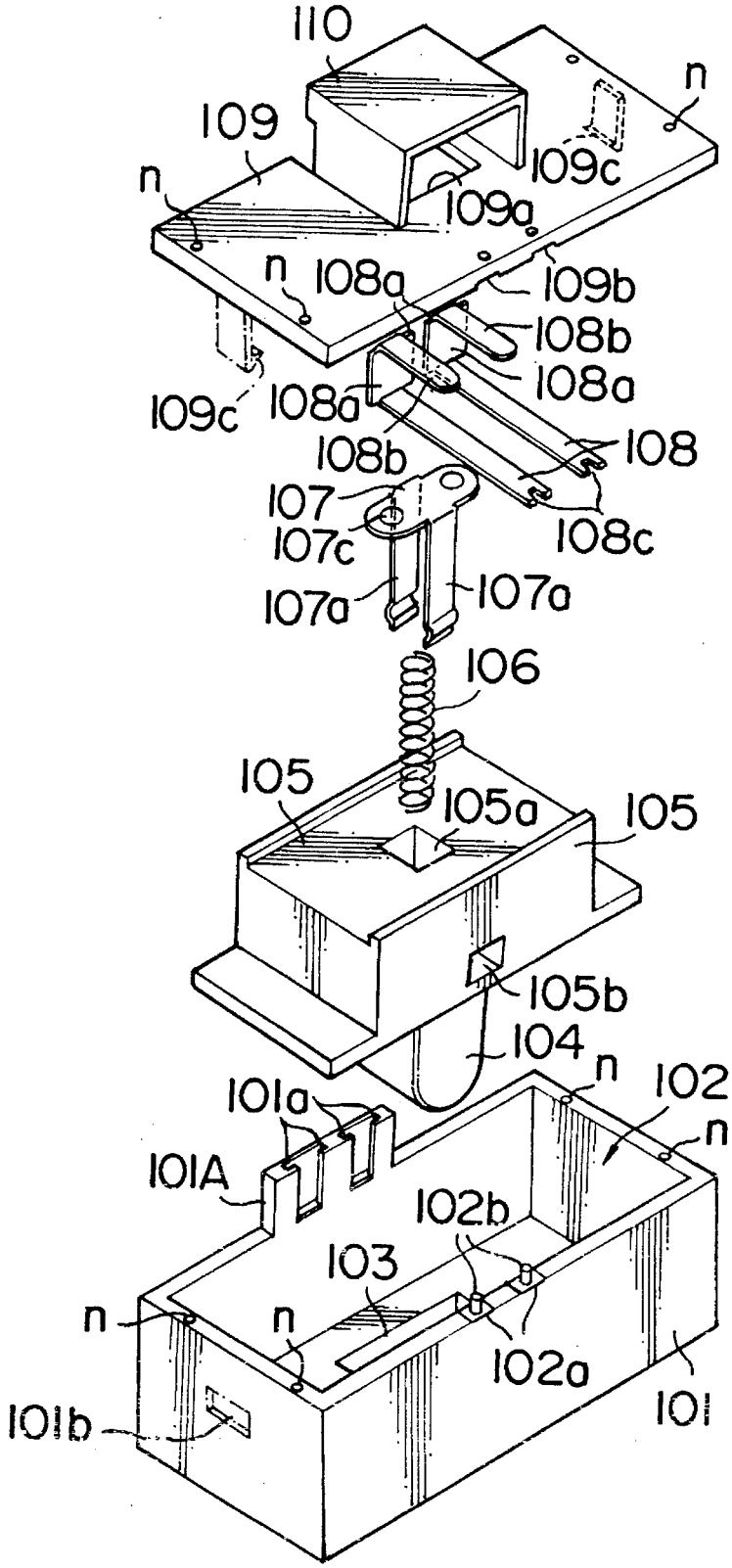
FIGS. 1A–1E are exploded perspective views of an embodiment of the present invention.
Figure 2A:
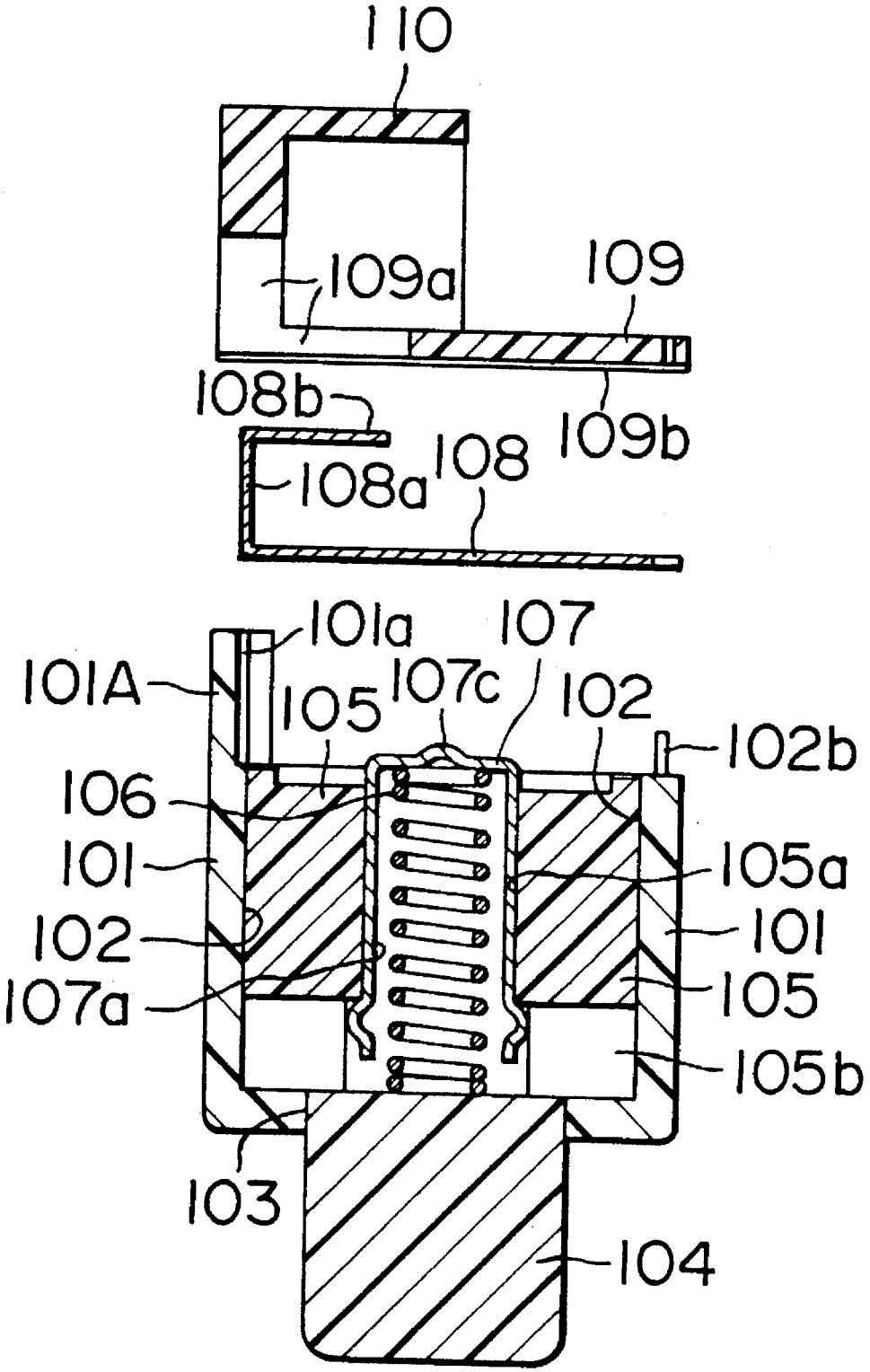
FIGS. 2A–2E are exploded cross-sectional views of an embodiment of the present invention.

Accompanying FIG. 1A depicts the basic structures of the present invention. Specifically, an insulating base 101 formed of a plastics material having a generally rectangular shape includes a recess 102. A slide body 105 is positioned within the recess 102 and includes a knob 104 which protrudes through slot 103 as shown in FIG. 2*a*. The slide 105 is thus movable within the recess 102 by manual manipulation of the knob 104 between at least first and second positions.

A movable contact 107 is provided with a pair of temporary locking legs 107*a*. As shown in FIG. 2A, the movable contact 107 is positioned within recess 105*a* which opens toward the outer surface of slide body 105 and is urged upwardly by means of resilient spring 106. Dimples 107*c* are preferably provided on the movable contact 107 so as to improve its electrical contact.

Figure 3A:
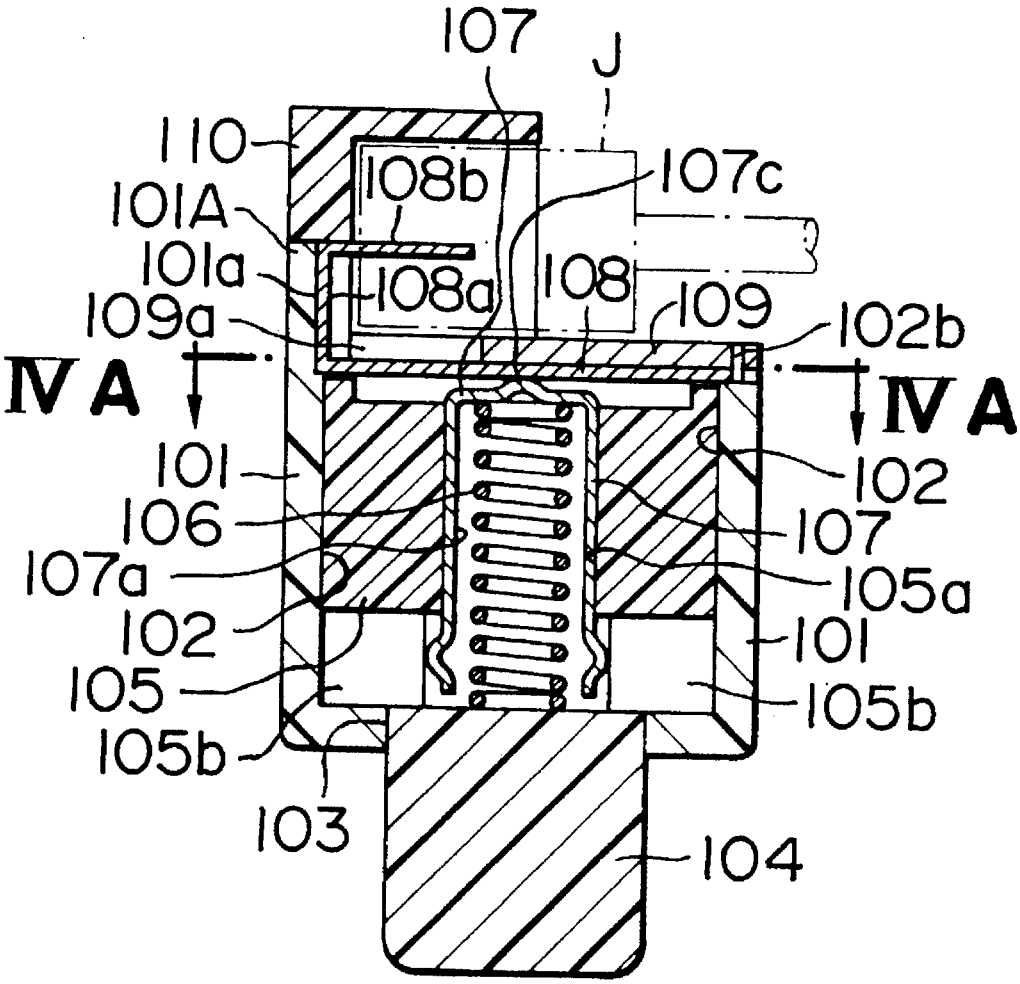
FIGS. 3A–3E are cross-sectional views following assembly of that shown in FIGS. 2A–2E.
Figure 4A:
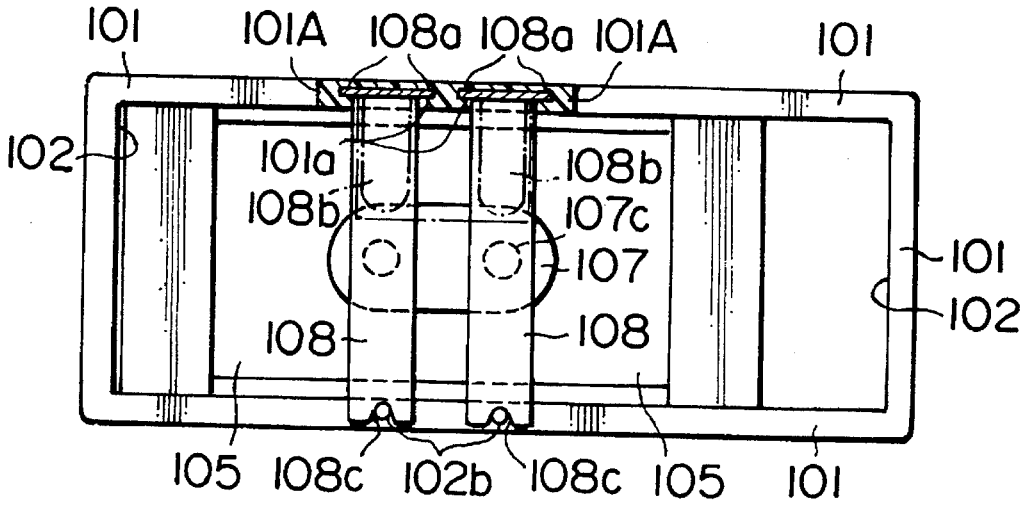
FIGS. 4A–4E are cross-sectional views taken along the broken line of FIGS. 3A–3E.
Figure 5A:
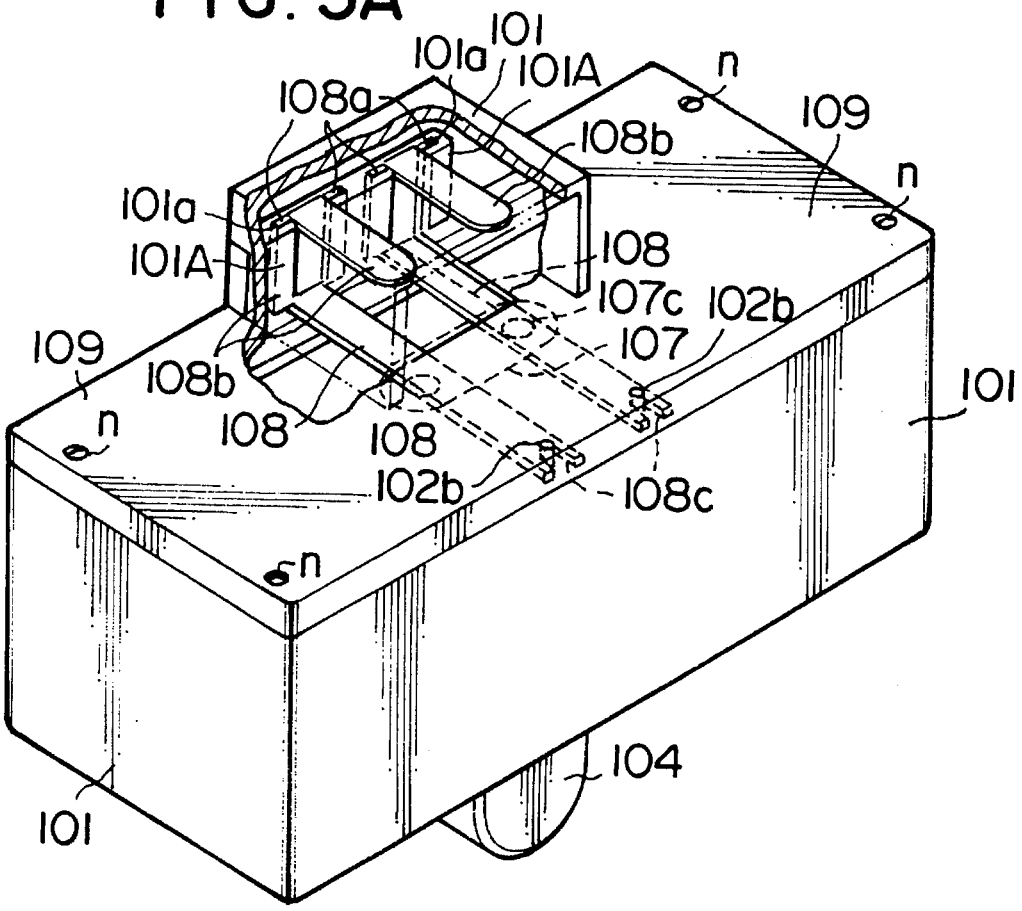
FIGS. 5A–5E are perspective views cutting out the essential portion following assembly of that shown in FIGS. 1A–1E.

A plurality of fixed contacts 108 made of metal strips transversely extend relative to the slot 103. As such, the movable contact 107 (particularly the dimples 107*c*) are capable of making sliding contact with the fixed contacts 108 when the slide body is moved. As shown in FIG. 4A, the fixed contacts 108 are positioned by means of positioning grooves 102*a* and pins 102*b* provided on the upper edge of the insulating base 101. A slide switch can then be constructed by covering the recess 102 of the base 101 with an insulating cover plate 109. The cover plate 109 may be fastened to the base 101 with screws in screw holes n as shown in FIGS. 3A and 5A.

According to the present invention, the back half of at least one, and preferably each, of the fixed contacts 108 is bent into a generally U-shape as shown in FIG. 1A. That is, the riser support pieces 108*a* and the forwardly extending plugs 108*b* are disposed in mutually perpendicular planes. The riser support pieces 108*a* are inserted into the generally T-shaped projecting piece grooves 101*a* formed vertically in projecting piece 101A of the insulating base 101 as shown in FIGS. 3A and 4A. The periphery of plugs 108*b* on the ends of the riser support pieces 108*a* can thus be protected by covering them with a plug cover 110 formed integrally with the insulating plate 109 and provided with hole 109*a*.

The position of each fixed contact 108 is restricted by inner grooves 109*b* of insulating plate 109. The insulating plate 109 can be attached to base 101 by any known fixing means, such as by hooking resilient tab 109*c* (shown in broken line in FIG. 1A) on the upper edge of side wall recess 101*b* of base 101.

Figure 6A:
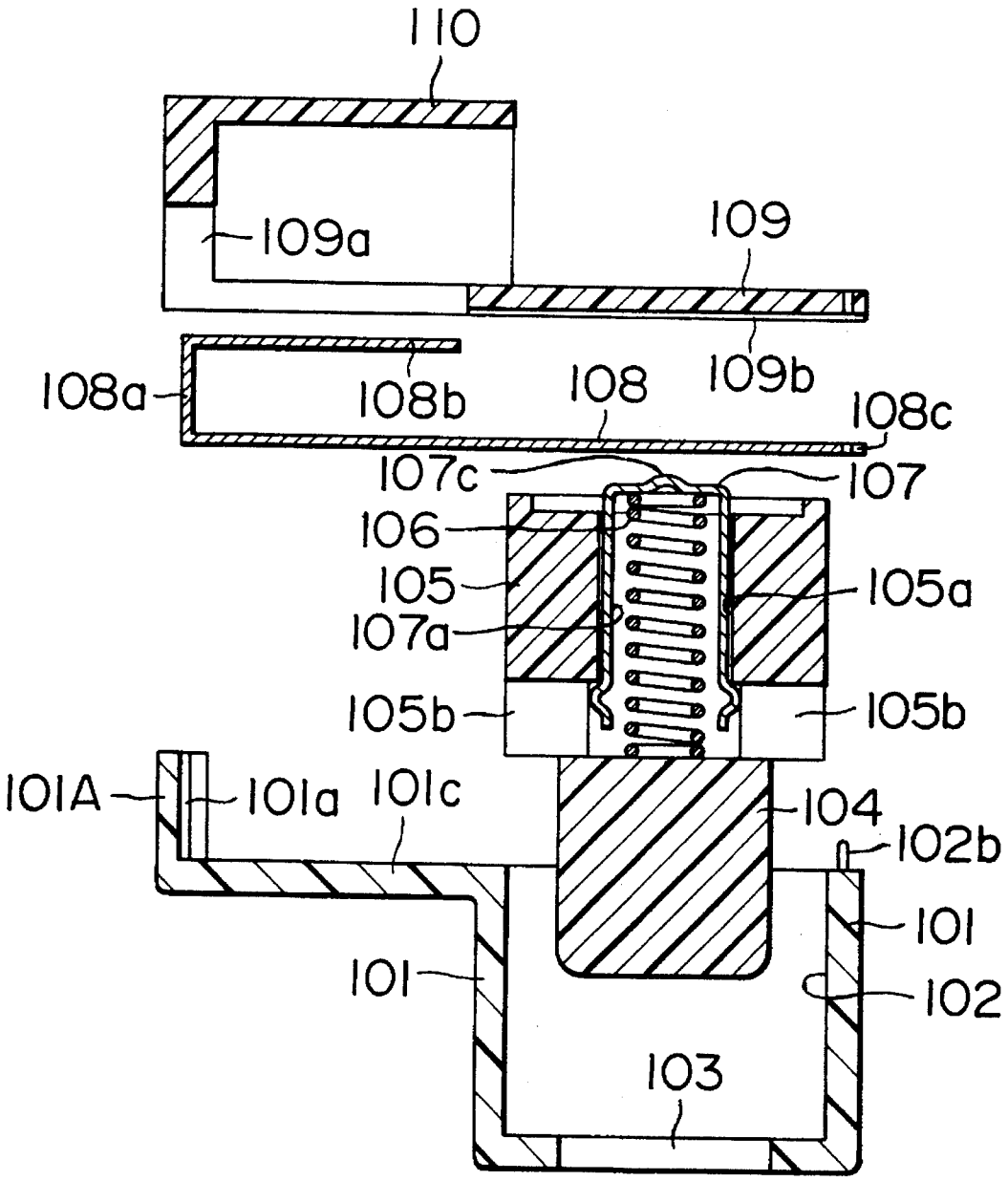
FIGS. 6A–6E are exploded cross-sectional views showing another example of the present invention.
Figure 7A:
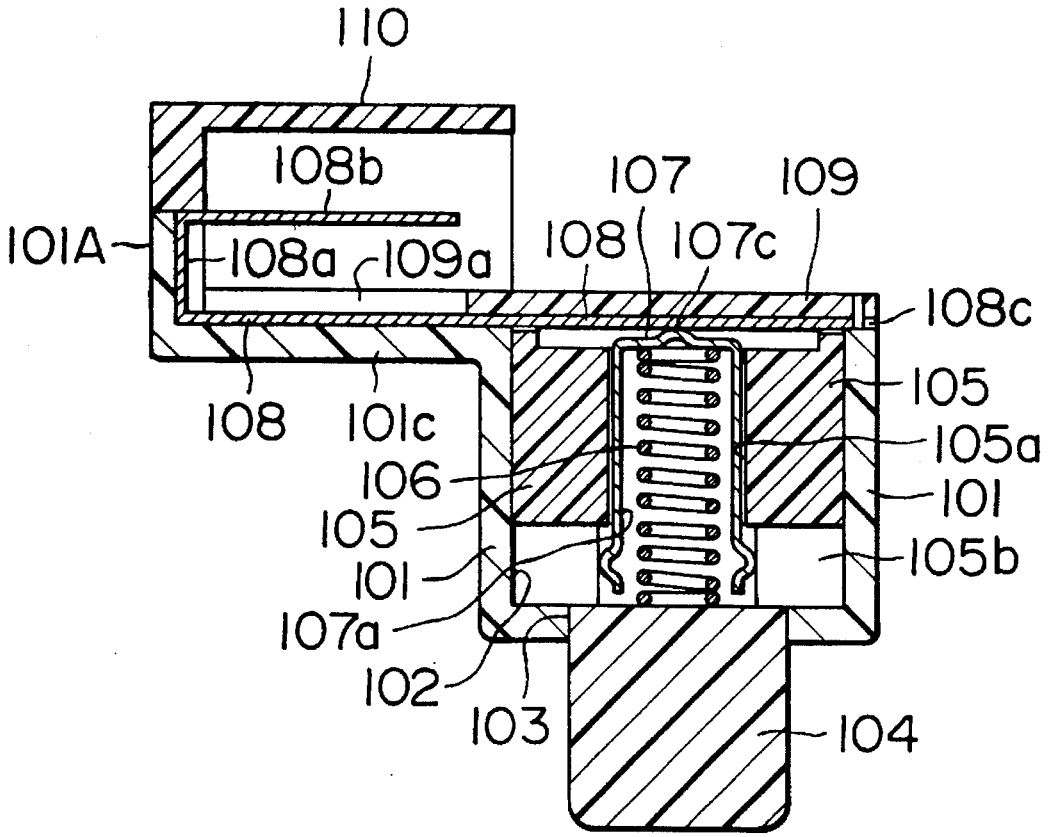
FIGS. 7A–7E are cross-sectional views showing another example of the present invention.

In order to conceal the entire outer surface of fixed contacts 108 with insulating plate 109, overhang 101*c* is provided and protrudes from the side of insulating base 101 as shown in FIGS. 6A and 7A. The vicinity of the U-shaped riser support portions 108*a* of fixed contacts 108 extend towards the back and is placed at this overhang portion. By then covering insulating plate 109 (which has a slightly larger width) over the top of fixed contacts 108 as shown in FIG. 7A, the entire outer surface of fixed contacts 108 can be protected as a result of being concealed by insulating plate 109 while also protecting plugs 108*b* with plug cover 110.

One of fixed contacts 108 is grounded directly, or through a lamp, to the automobile chassis. A conventional plug-in jack J (see FIG. 3A) is connected to form a circuit to only one other fixed contact 108 by forming plugs 108*b* through U-shaped riser support pieces 108*a* and covering them with plug cover 110. The other fixed contacts 108 may be grounded to the body as described above.

Figure 8:
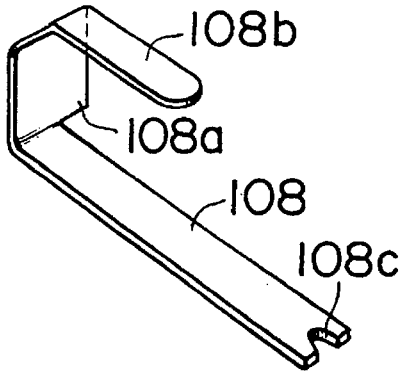
FIG. 8 is a perspective view showing another example of the rising support piece according to the present invention.
Figure 9:
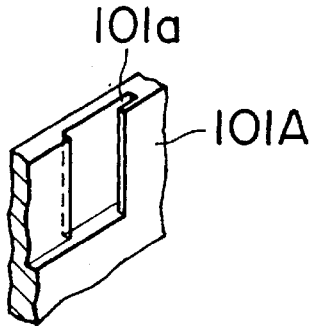
FIG. 9 is a perspective view showing another example of the projecting piece groove according to the present invention.
Figure 10:
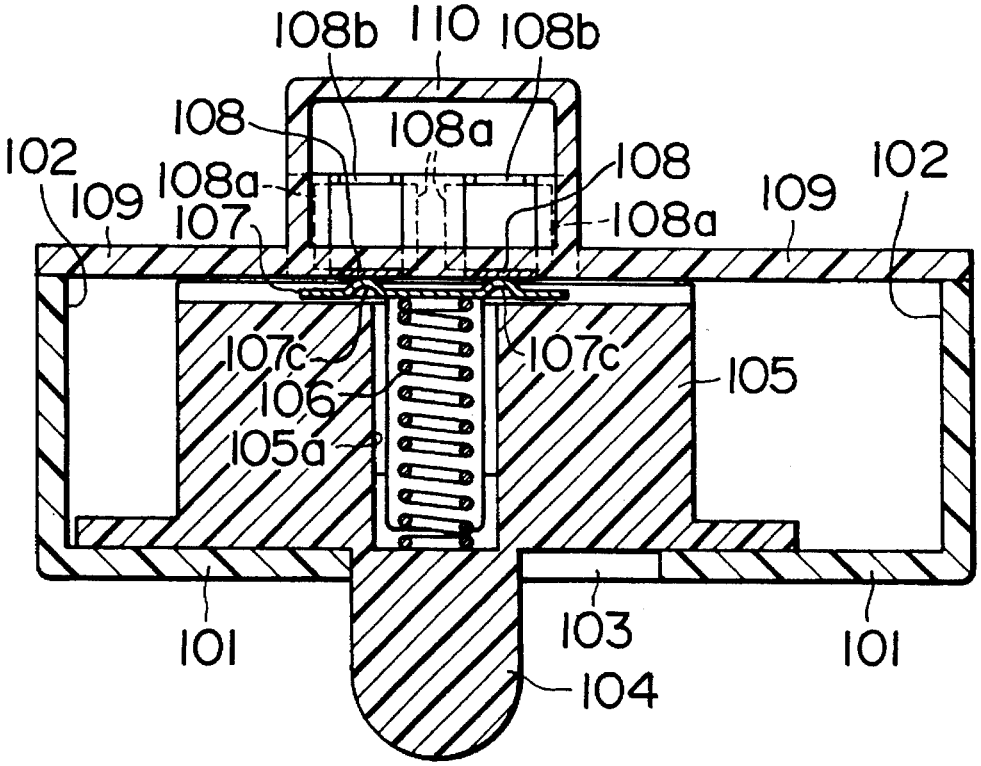
FIG. 10 is a longitudinal cross-sectional view showing an example of use of the product of the present invention.

The shape of riser support pieces 108*a* of fixed contacts 108 can themselves be made so that a portion extends laterally as shown in FIG. 8. Such riser support pieces 108*a* can then be inserted into base projecting piece grooves 101*a* as shown in FIG. 9 for purposes of support.

If three or more fixed contacts 108 are provided, two each of adjacent fixed contacts 108 can be sequentially switched on and off with movable contact 107, enabling the present invention to be used as a switching slide switch.

The portions in FIG. 1A indicated with the reference numeral 108*c* enable positioning and orientation of the fixed contacts 108 to be performed reliably by aligning the V-shaped notches or holes with pins 101*b* of base 1 01.

Figure 1B:
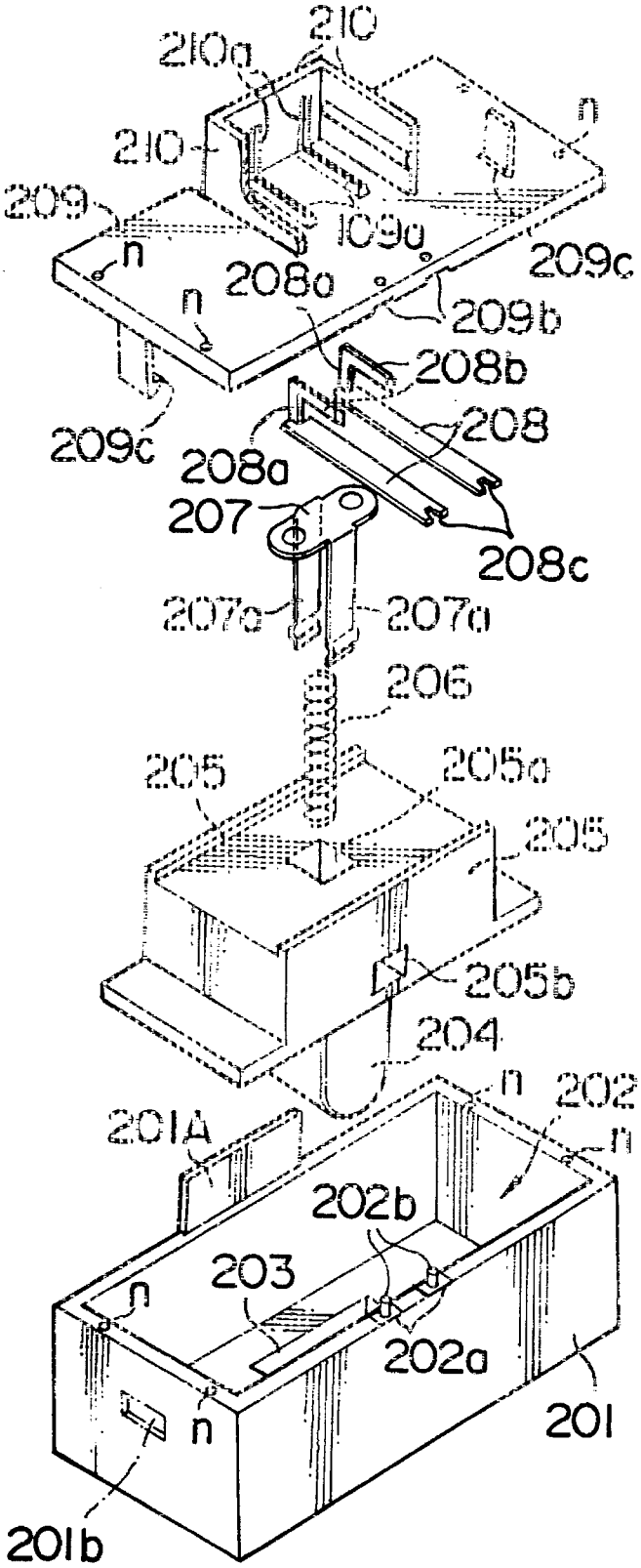
Figure 1C:
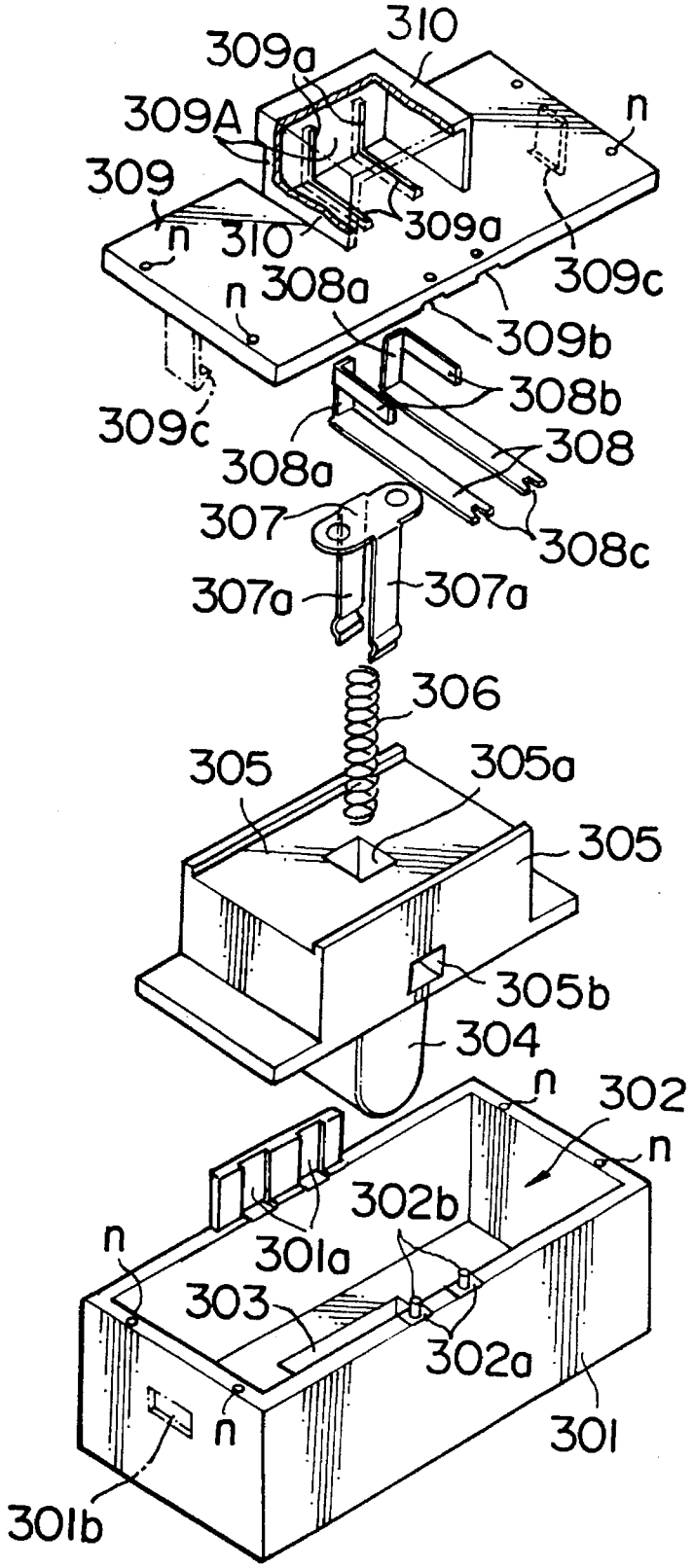
Figure 11:
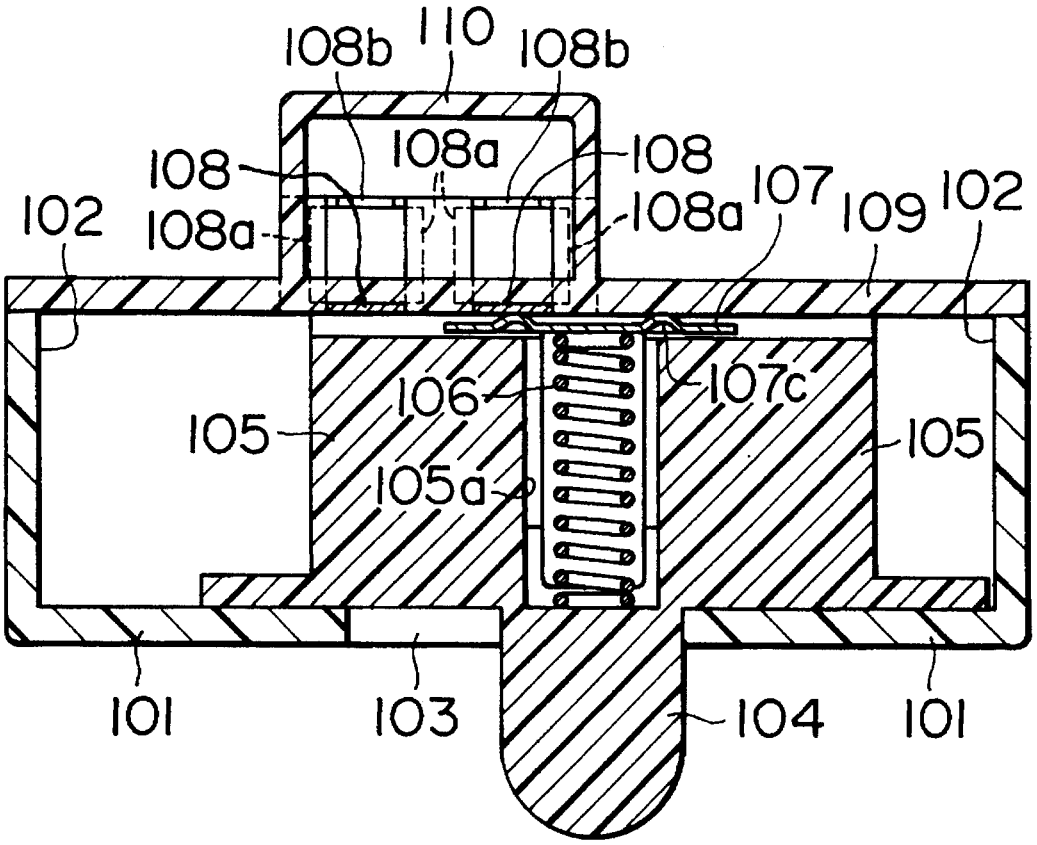
FIG. 11 is a longitudinal cross-sectional view of a different state of that shown in FIG. 10.
Figure 12:
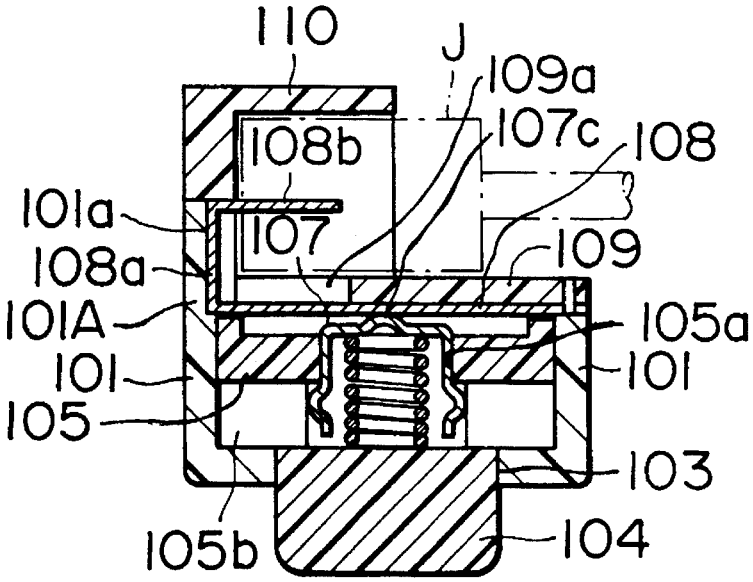
FIG. 12 is a cross-sectional view of an assembly example in which the temporary locking legs of the movable contact have been shortened.
Figure 13:
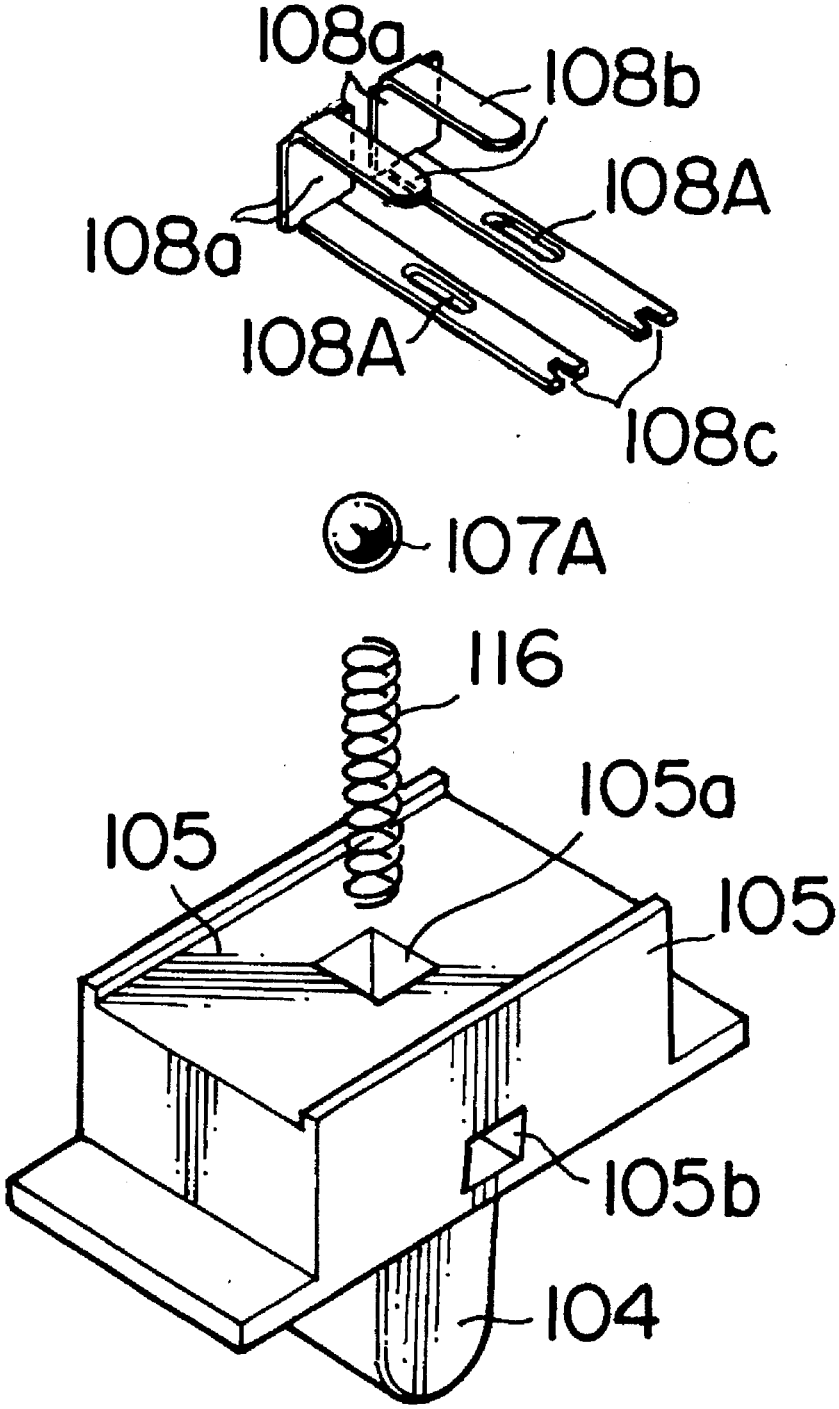
FIG. 13 is an exploded perspective view showing another embodiment of the present invention.
Figure 14:
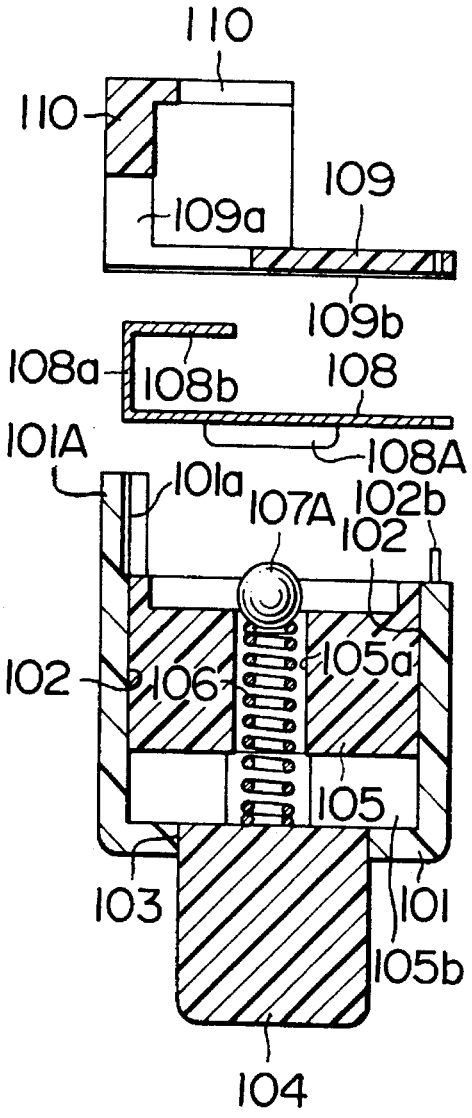
FIG. 14 is an exploded perspective view showing another embodiment of the present invention.
Figure 15:
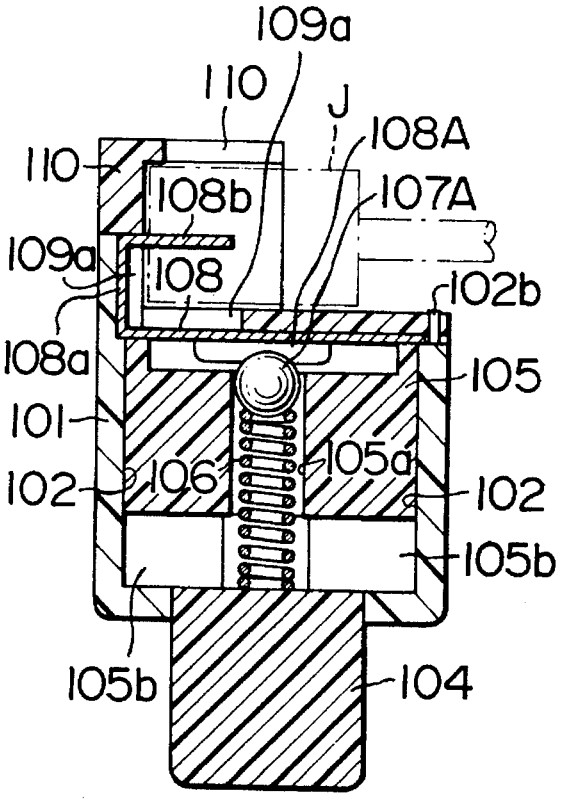
FIG. 15 is a cross-sectional view following assembly of that shown in FIG. 13.

Accompanying FIG. 1C depicts an operational state in which movable contact 107 is operated to the left. the space between fixed contacts 108 can be made to be continuous by straddling the two contact points 107*c* of movable contact 107. Thereafter, when knob 104 is operated to the right as shown in FIG. 11, one of the contact points on the right side of the movable contact 107 makes contact with the inner surface of insulating plate 109 and the continuity between each fixed contact 108 is interrupted thereby enabling the switch to be turned off. If, for example, the positive pole of a power source is connected to one of the plugs 108*b* and the negative pole of a power source is connected to the other plug 108*b* through a load, such as an automotive door switch or lamp in series, the continuity between fixed contacts 108 may then be controlled with movable contact 107 by moving sliding body 105. It is therefore possible to, for example, manually turn on and off an interior lamp or turn on an interior lamp automatically when a car door is opened. Furthermore, if the dimensions of guide legs 107*a* of movable contact 107 and the associated resilient spring 106 are shortened as shown in FIG. 12, a significantly flatter slide switch can be constructed. The molding pin extraction hole 105*b* ends up being formed in sliding body 105 as shown in FIGS. 1A and 3A so as to expand the back of recess 102 as shown in FIGS. 2A and 3A.

Figure 2B:
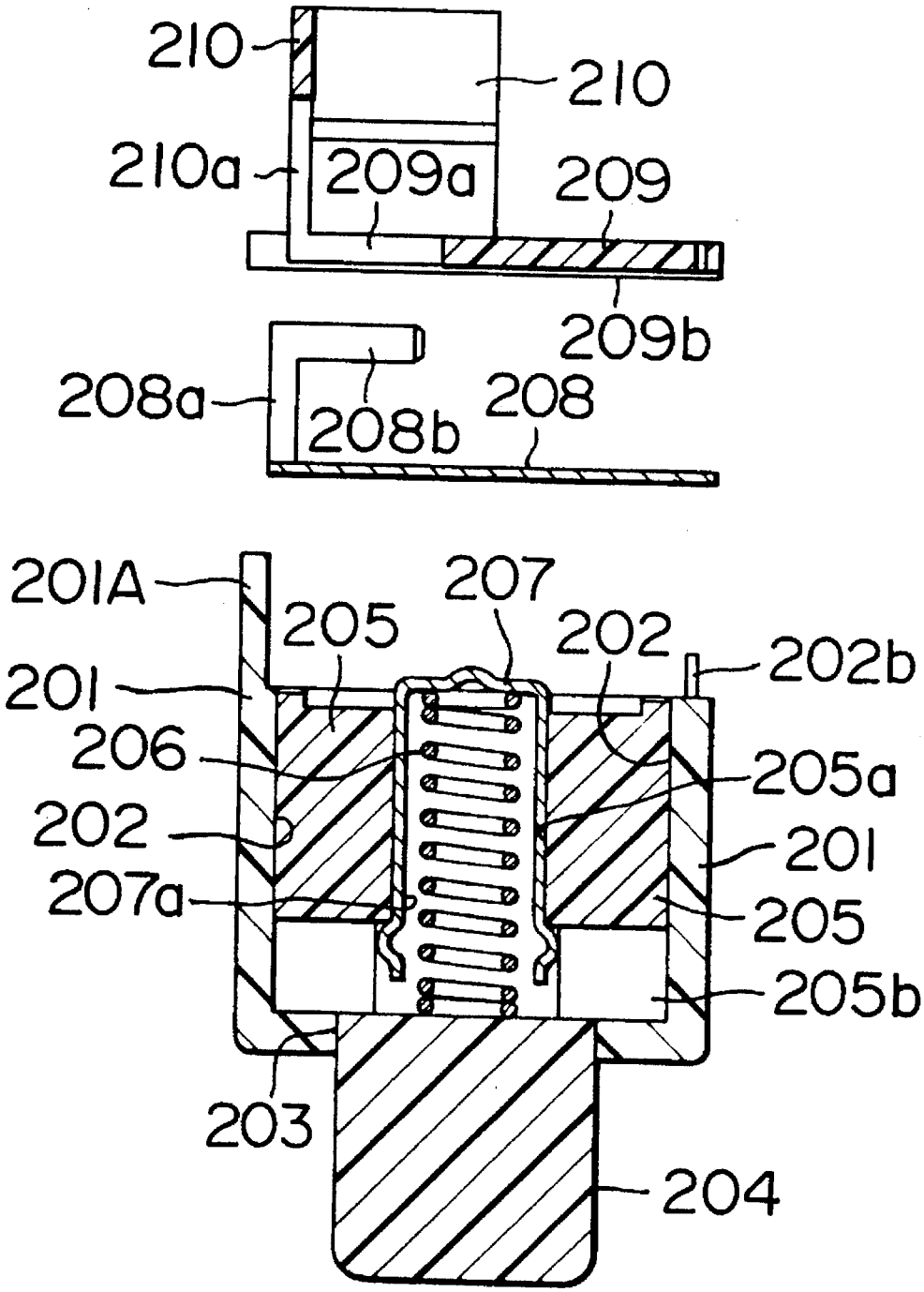

Another embodiment of the present invention is shown in FIGS. 1B and 2B. As shown, this embodiment of the slide switch according to the present invention includes knob 204 which outwardly protrudes from slot 203. Slot 203 communicates with recess 202 of insulating base 201 which is formed from a plastics in the shape of a hollow rectangle. A sliding body 205, also made of a plastics material, is movably provided within recess 202 of the insulating base 201.

Movable contact 207 has a pair of temporary locking legs 207*a* and is resiliently provided within recess 205*a* as shown in FIG. 2B. The movable contact 207 is exposed at the outer surface of the sliding body 205 and is urged outwardly by means of resilient coil spring 206. A plurality of fixed contacts 208, made from metal strips, will therefore make contact with the outer surface of the movable contact 207. The fixed contacts are arranged in parallel as shown in FIG. 4B by conventional positioning means, such as positioning grooves 202*a* and pins 202*b* provided on the upper edge of the insulating base recess 202. The slide switch can then be constructed by covering its outer surface with insulating plate 209 which is fastened with screws in screw holes n to base 201 as shown in FIGS. 3B and 5B.

According to the present invention, the back half of at least one, and preferably each of the fixed contacts 208, is bent into a general L-shape in the direction of their thickness as shown in FIG. 1B to form riser support pieces 208*a*. That is, the riser support pieces 208*a* and the plugs 208*b* are coplanar with one another. The plugs 208*b* extend towards the front and are oriented vertically as viewed from the front resulting in a form that is not inadvertently bent vertically.

Figure 3B:
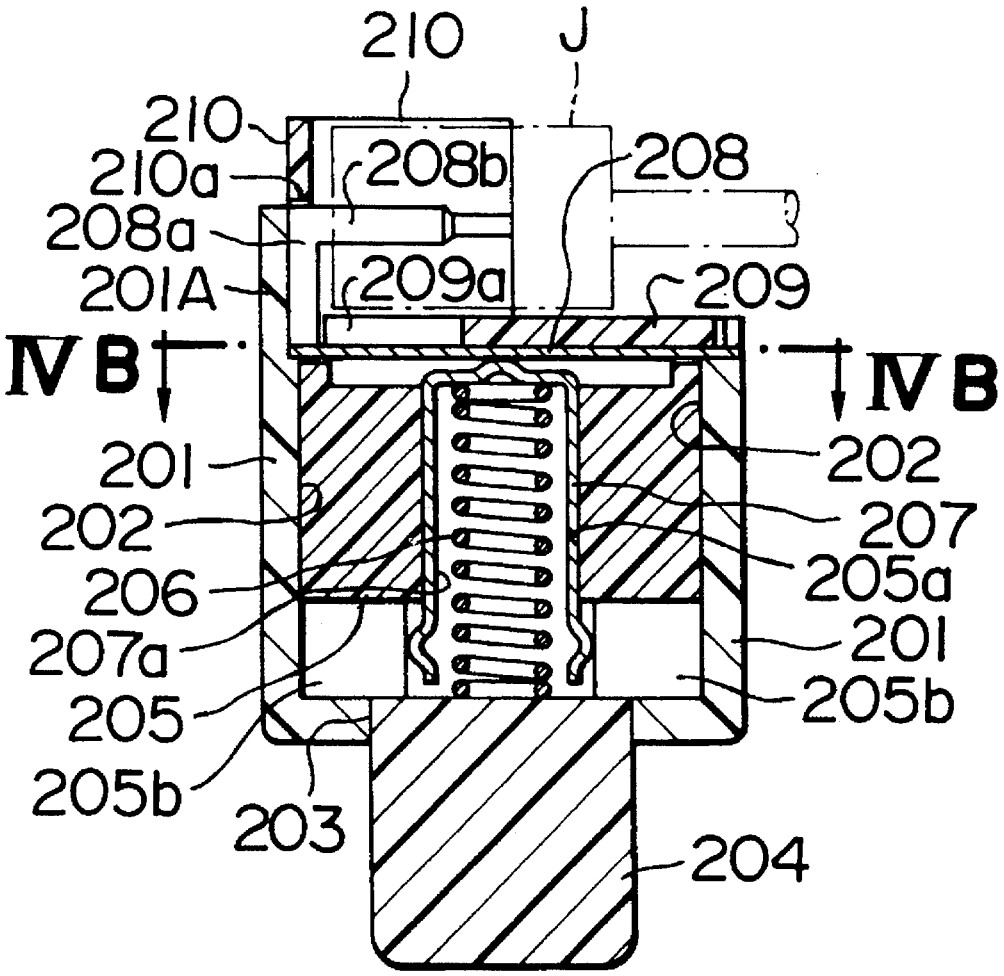
Figure 4B:
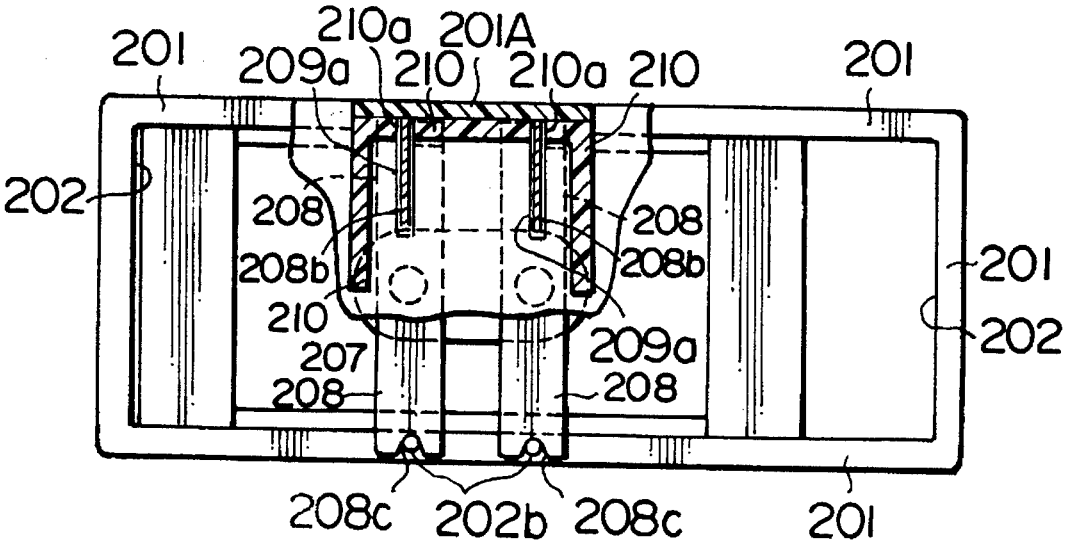
Figure 5B:
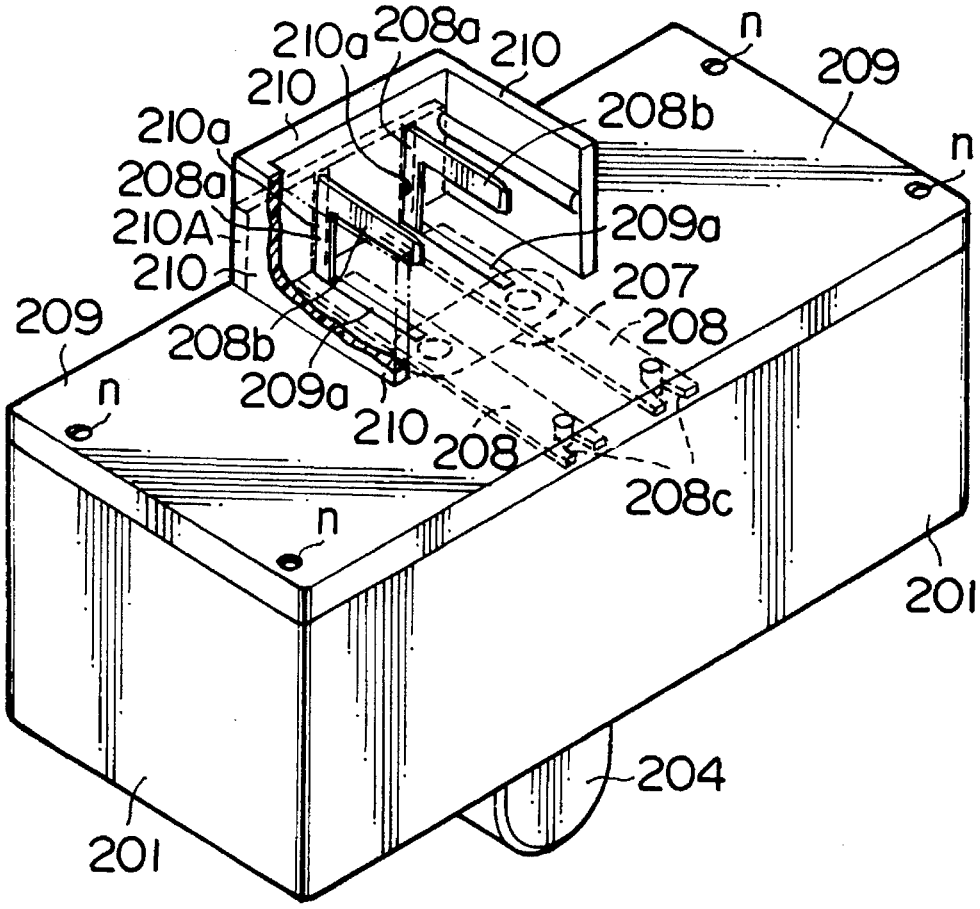

The back surfaces of riser support pieces 208*a* are brought into contact with projecting piece 201A of the base 201 as shown in FIGS. 3B and 4B. The insulating plate 209 is thereafter covered over the edge of the opening of base 201 via plugs 208*b* through slots 209*a* of insulating plate 209, and fixed to base 201 with screws or the like. The generally U-shaped guide piece 210 guides insertion of plug-in jack J (see FIG. 3B). The guide piece 210 protrudes from the periphery of slots 209*a* opened in insulating base 209 at the positions corresponding to the plugs 208*b*. By inserting the bases of plugs 208*b* into vertical grooves 210*a* formed in the rear wall of the guide piece 210, the periphery of the bases of the plugs 208*b* is surrounded by the edges of vertical grooves 210*a* as shown in FIGS. 3B and 5B. The slide switch according to the present invention is then constructed by securely positioning and reinforcing the bases of plugs 208*b*.

Since the riser support pieces 208*a* and plugs 208*b* are coplanar with one another, inadvertent bending or warping of the plugs 208*b* (e.g., due to insertion and removal of the jack J and/or external disturbances) is substantially prevented. Moreover, the bases of plugs 208*b* can be positioned by the edges of vertical grooves 210*a* of guide piece 210 so as to guide insertion of a plug-in jack J (see, FIG. 3B), while also reinforcing the plugs 208*b* in the direction of their thickness. Moreover, the fixed contacts 208 themselves are embedded in fixed contact positioning grooves 209*b* provided in the base projecting pieces 202*b* and in the opposing surfaces of base 201 or insulating plate 209, and are rigidly positioned by screws or other known means. In addition, the insulating plate 209 can be attached to base 201 by any conventional fixing means, such as by hooking resilient tab 209*c* (shown in broken line in FIG. 1B) on the upper edge of side wall recess 201*b* of base 201.

Figure 6B:
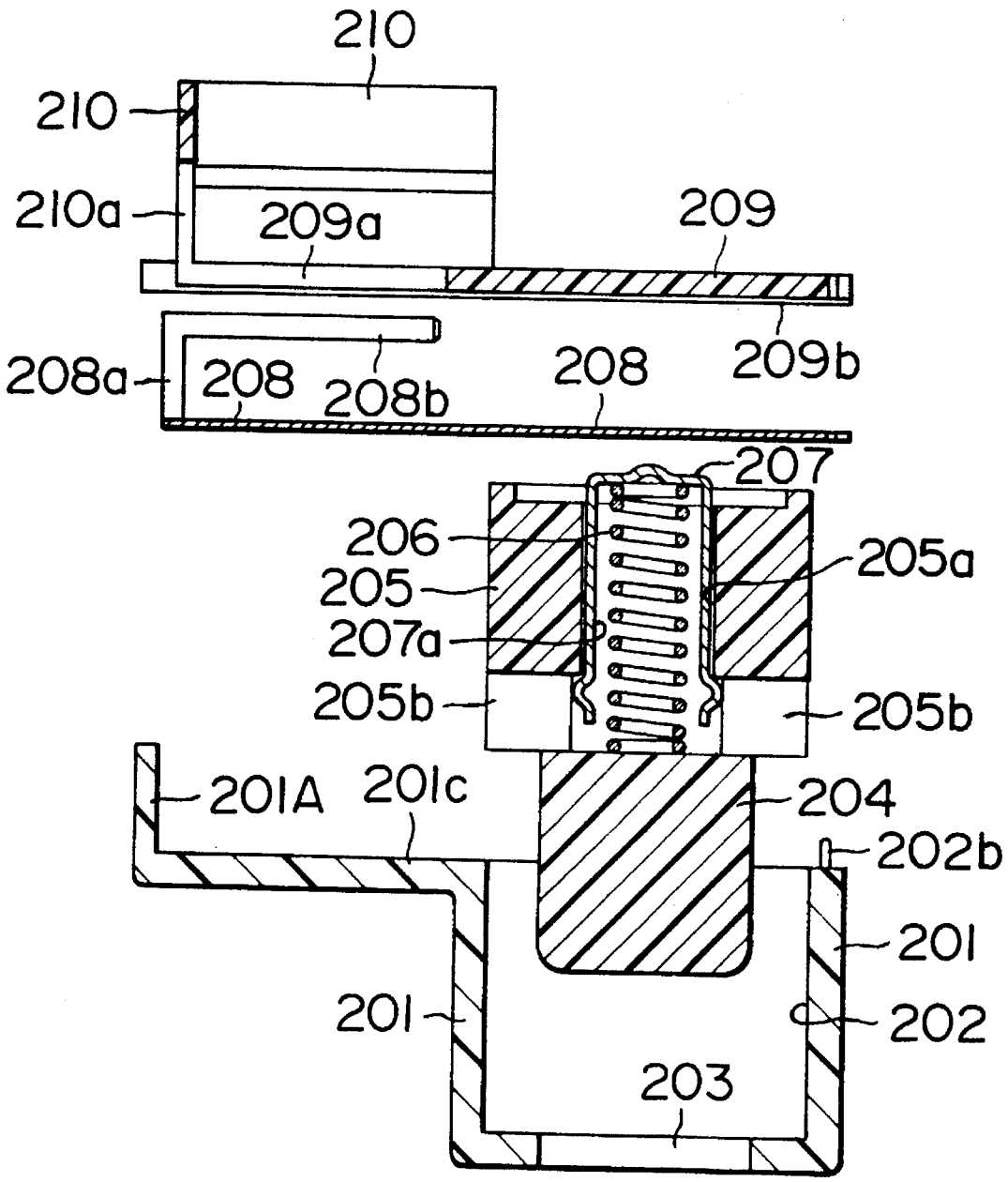
Figure 7B:
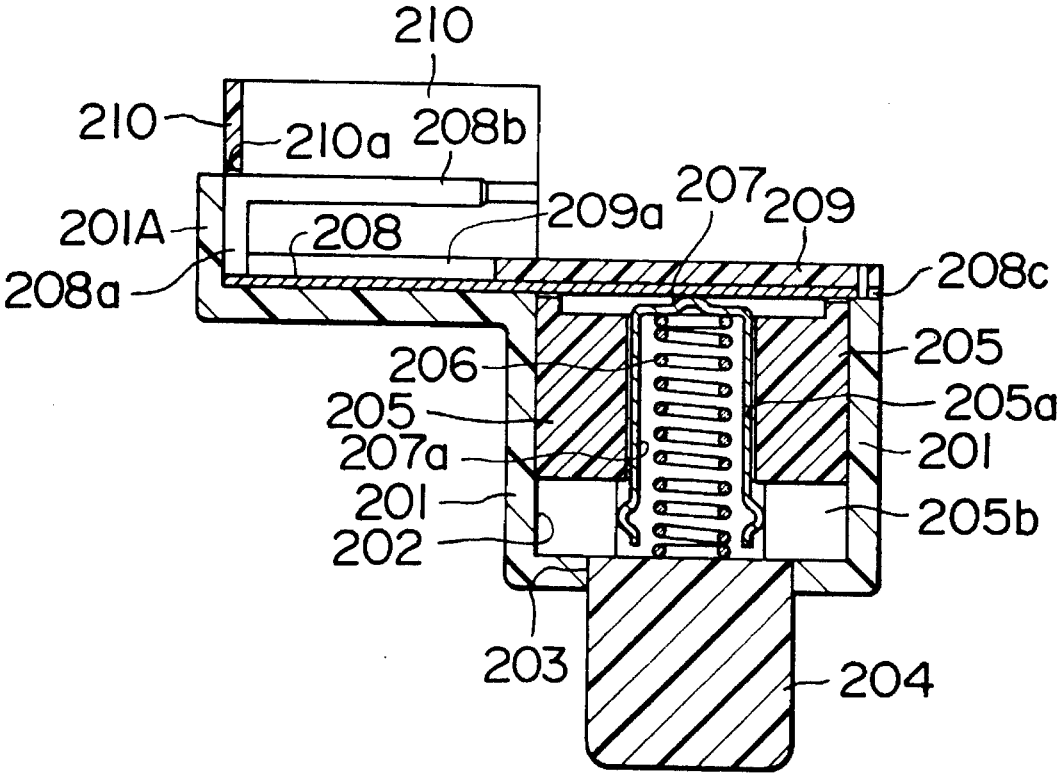

In order to conceal the entire outer surface of fixed contacts 208 with insulating plate 209, an overhang 201*c* is provided which protrudes from the side of insulating base 201 as shown in FIGS. 6B and 7B. The vicinity of the U-shaped riser portions 208*a* of fixed contacts 208 is placed at this overhang portion 201*c*. By then covering insulating plate 209, which has a slightly larger width, over the top of fixed contacts 208 as shown in FIG. 7B, the entire outer surface of fixed contacts 208 can be protected as a result of being concealed by insulating plate 209.

One of fixed contacts 208 is grounded directly or through a lamp to the automobile chassis. A conventional plug-in jack J (see FIG. 3B) is connected to form a circuit to only one of the other fixed contacts 208 by making contact with a respective one of the plugs 208*b* positioned within plug cover 210. The other fixed contact 208 may be grounded to the body with screws, for example. In addition, if three or more fixed contacts 208 are provided, two each of adjacent fixed contacts 208 can be sequentially switched on and off with movable contact 207, enabling the present invention to be used as a switching slide switch. The portions in FIG. 1B indicated with the reference numeral 208*c* enable positioning and orientation of fixed contacts 208 to be performed reliably by aligning the V-shaped notches or holes with pins 201*b* of the base 201.

Figure 2C:
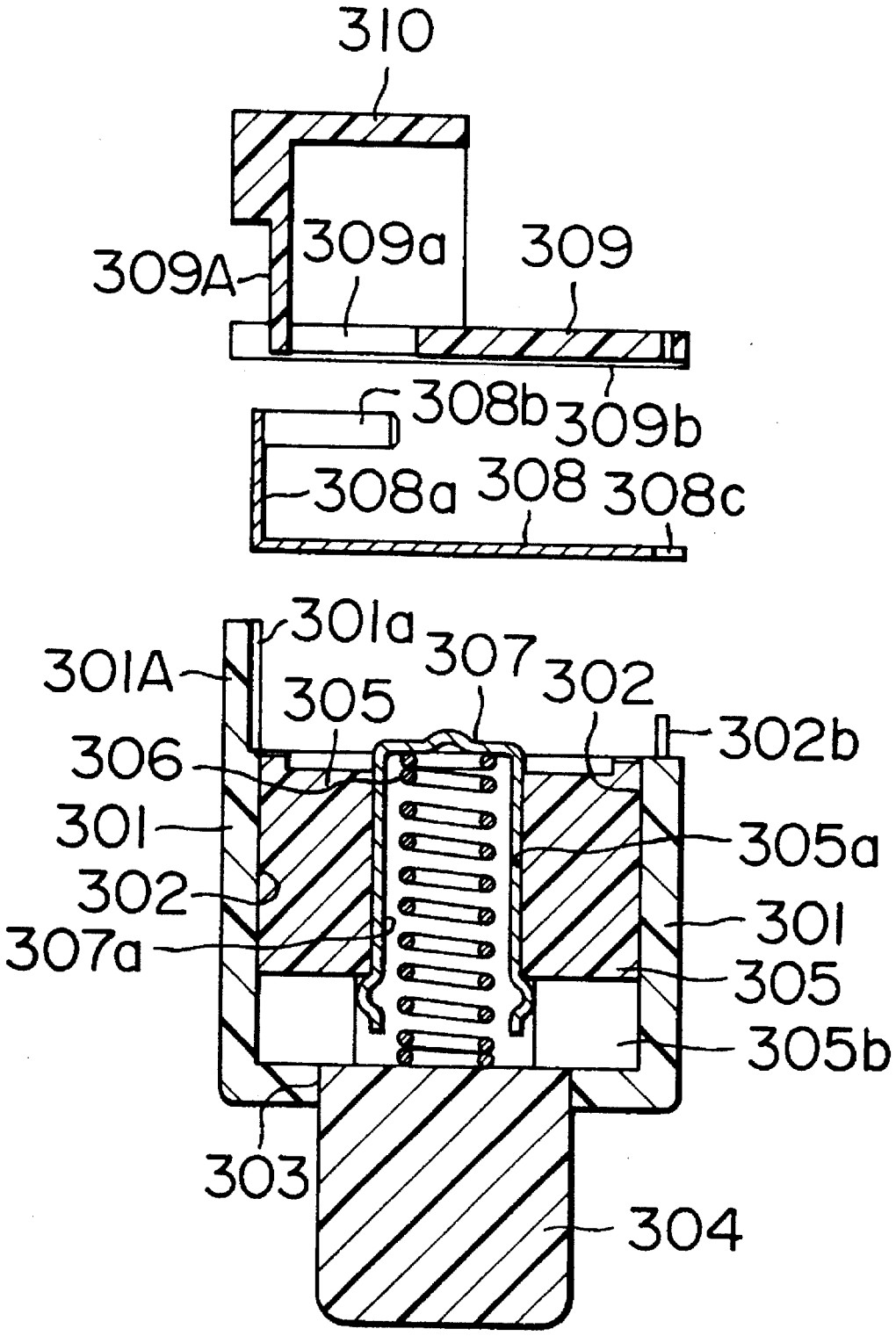

Another embodiment of the present invention is shown in accompanying FIG. 1C. As seen, the slide switch depicted therein includes a knob 304 which outwardly protrudes from the slot 303 as shown in FIG. 2C. Slot 303 communicates with recess 302 of insulating base 301 which is formed from a plastics material in the shape of a hollow rectangle. A sliding body 305, also made of a plastics material, is movably provided within recess 302 of the insulating base 301.

Movable contact 307 has a pair of temporary locking legs 307*a* and is resiliently provided within recess 305*a* as shown in FIG. 2C. The movable contact 307 is exposed at the outer surface of the sliding body 305 and is urged outwardly by means of resilient coil spring 306. A plurality of fixed contacts 308, made from metal strips, will therefore make sliding contact with the outer surface of the movable contact 307. The fixed contacts 308 are arranged in parallel as shown in FIG. 4C by means of positioning grooves 302*a* and pins 302*b* provided on the upper edge of the insulating base recess 302. The slide switch can then be constructed by covering its outer surface with insulating plate 309 which is fastened with screws in screw holes n to base 301 as shown in FIGS. 3C and 5C.

According to the present invention, the back half of at least one, and preferably each of the fixed contacts 308, is bent into a general L-shape as shown in FIG. 1C to form riser support pieces 308*a* and plugs 308*b*. That is, the riser support pieces 308*a* and the plugs 308*b* are disposed in mutually perpendicular planes. The plugs 308*b* extend towards the front and are oriented vertically as viewed from the front resulting in a form that is not inadvertently bent vertically.

Figure 3C:
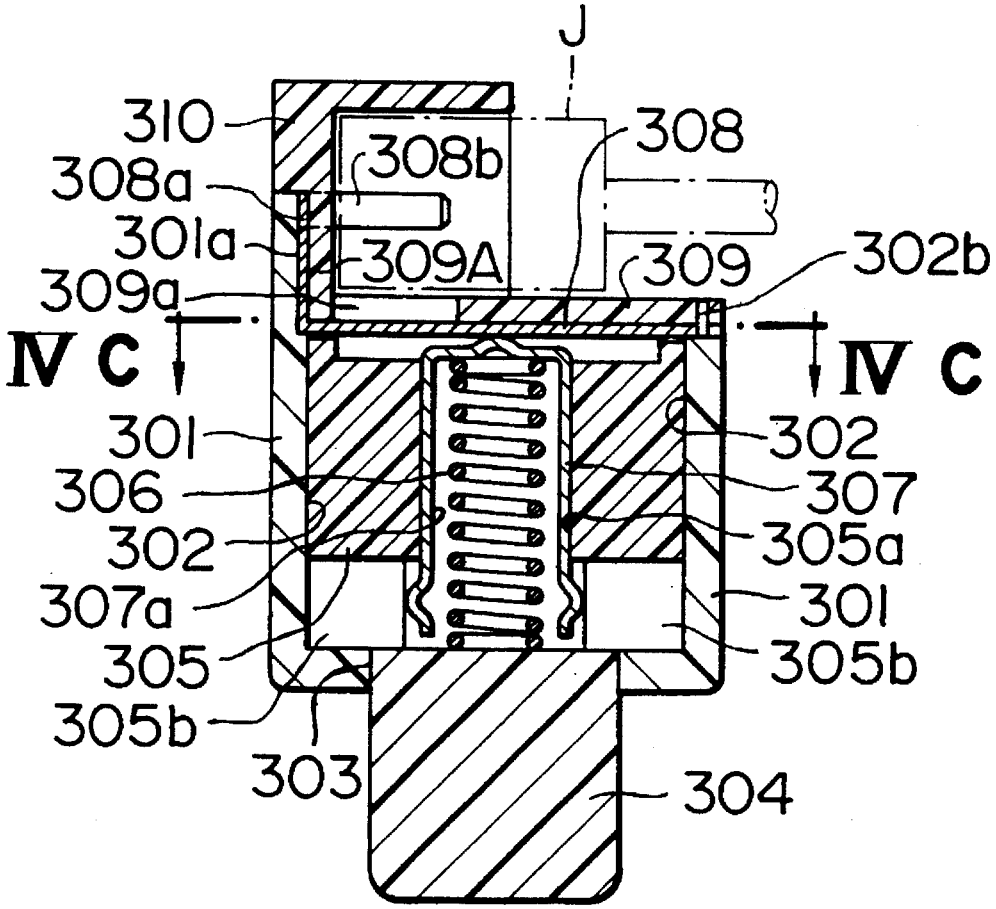
Figure 4C:
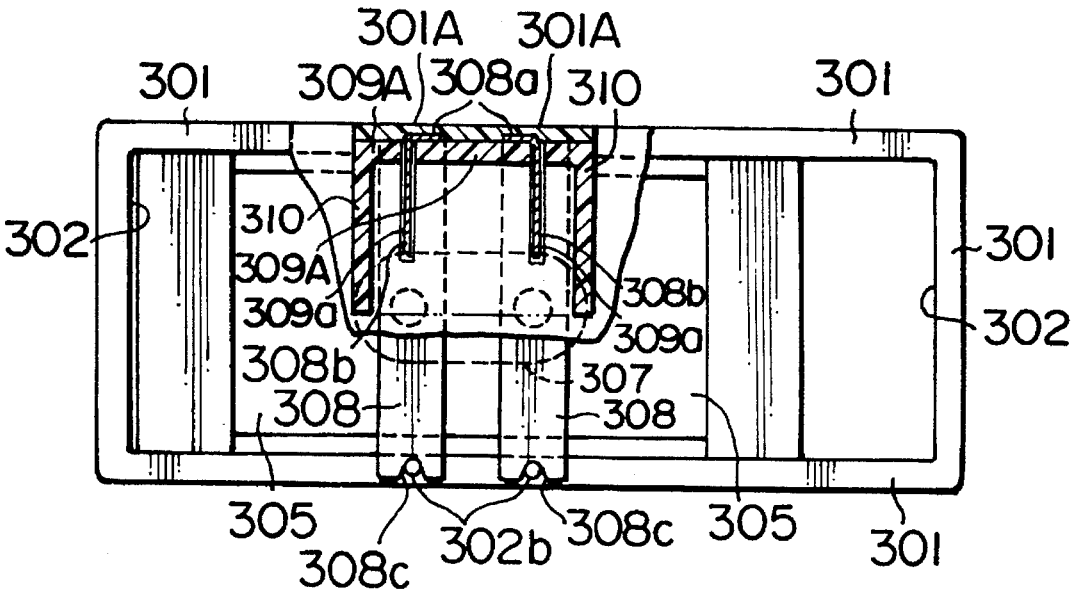

The back surfaces of rising support pieces 308*a* are brought into contact with recess grooves 301*a* formed vertically in projecting piece 301A of the base 301 as shown in FIGS. 3C and 4C. The inner surfaces of the riser support pieces 308*a* are supported by their contact with the outer surfaces of projecting piece 309A perpendicularly provided on the back edge of insulating plate 309. The insulating plate 309 is fixed to the base 301 with screws or the like. The plugs 308*b* extend through slots 309*a* of said insulating plate 309 so as to be housed within the plug cover 310.

Figure 5C:
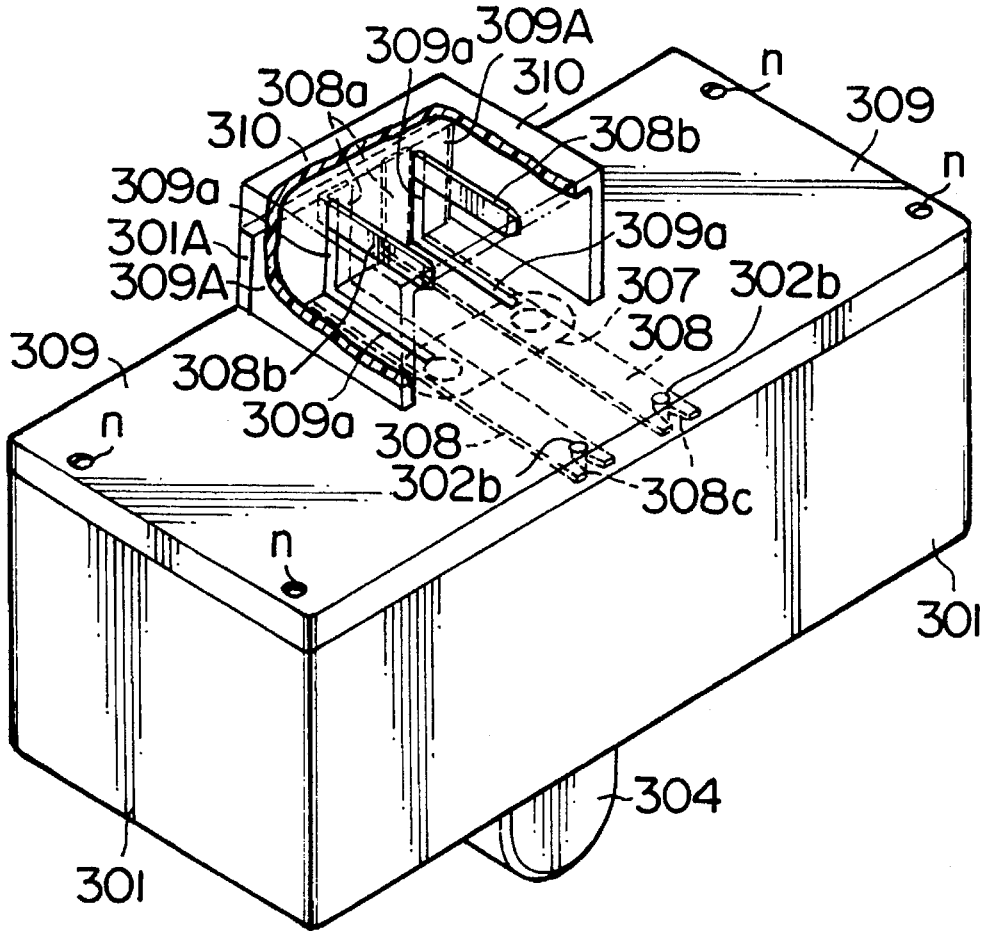

As a result of protecting the periphery of the plugs 308*b* by covering them with the plug cover 310 as shown in FIGS. 3C and 5C, the slide switch according to the present invention can be constructed wherein the riser support pieces 308*a* are securely clamped by each projecting piece 301A and 309A of base 301 and the insulating plate 309, respectively. In addition, the position of each fixed contact 308 is restricted by inner grooves 309*b* of insulating plate 309. The insulating plate 309 can be attached to base 301 by any known fixing means, such as by hooking resilient tab 309*c* (shown in broken line in FIG. 1C) on the upper edge of side wall recess 301*b* of base 301.

Figure 6C:
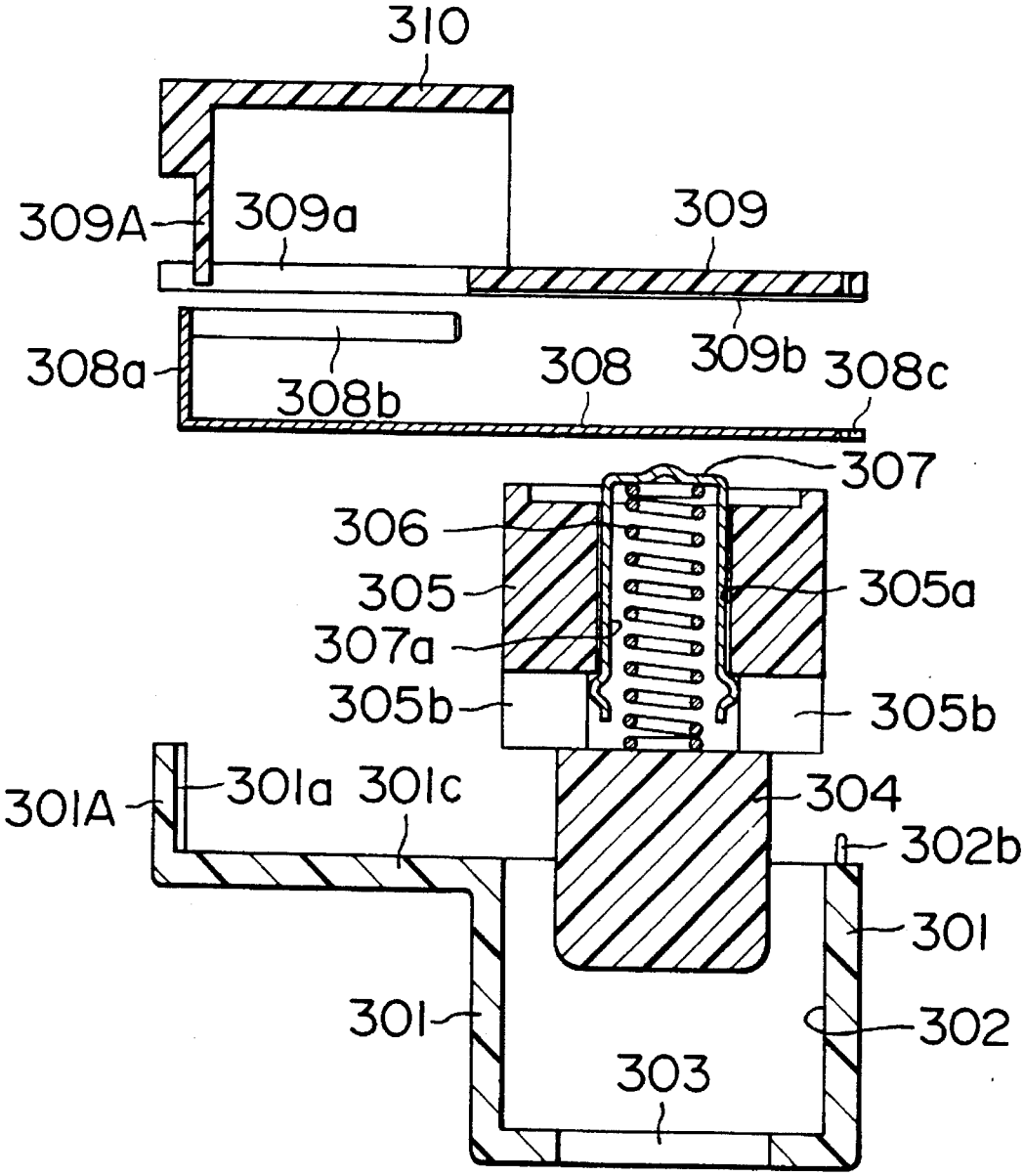
Figure 7C:
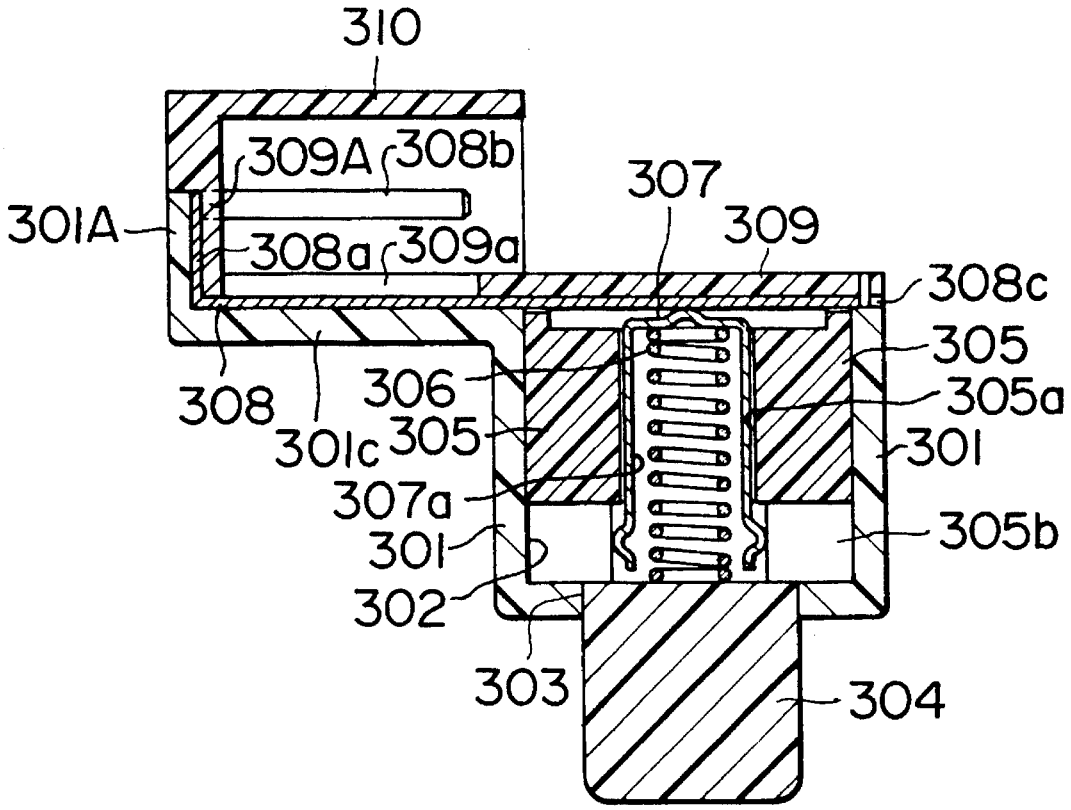

In order to conceal the entire outer surface of fixed contacts 308 with insulating plate 309, an overhang 301*c* is provided which protrudes from the side of insulating base 301 as shown in FIGS. 6C and 7C. The vicinity of the U-shaped riser portions 308*a* of fixed contacts 308 is placed at this overhang portion 301*c*. By then covering insulating plate 309, which has a slightly larger width, over the top of fixed contacts 308 as shown in FIG. 7C, the entire outer surface of fixed contacts 308 can be protected as a result of being concealed by insulating plate 309.

One of fixed contacts 308 is grounded directly or through a lamp to the automobile chassis. A conventional plug-in jack J (see FIG. 3C) is connected to form a circuit to only one of the other fixed contacts 308 by making contact with a respective one of the plugs 308*b* positioned within plug cover 310. The other fixed contact 308 may be grounded to the body with screws, for example. In addition, if three or more fixed contacts 308 are provided, two each of adjacent fixed contacts 308 can be sequentially switched on and off with movable contact 307, enabling the present invention to be used as a switching slide switch. The portions in FIG. 1C indicated with the reference numeral 308*c* enable positioning and orientation of fixed contacts 308 to be performed reliably by aligning the V-shaped notches or holes with pins 301*b* of the base 301. The shape of plugs 308*b* can be such that the riser portions 308*a* have the lateral extension similar to riser portions 108a shown in FIG. 8 for purposes of being fitted within a groove similar to groove 101 a as shown in FIG. 9.

Figure 1D:
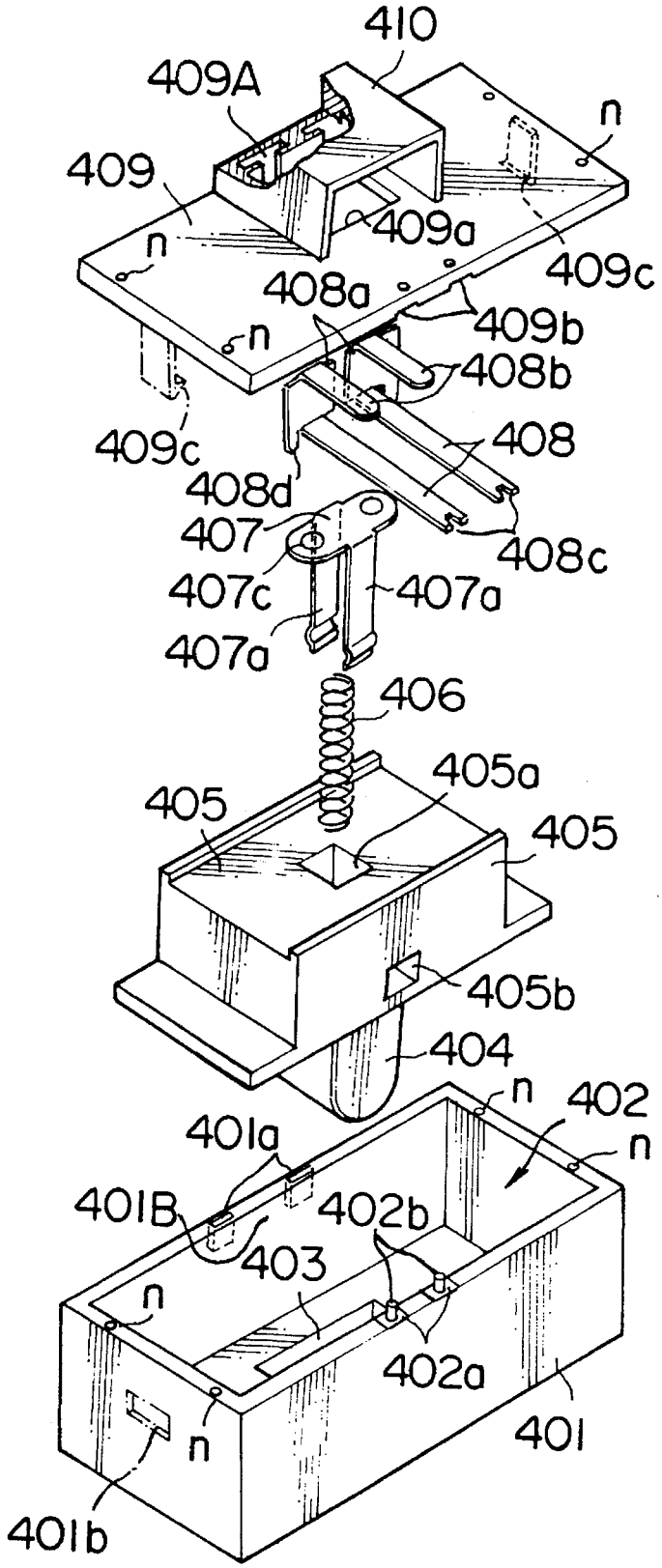
Figure 2D:
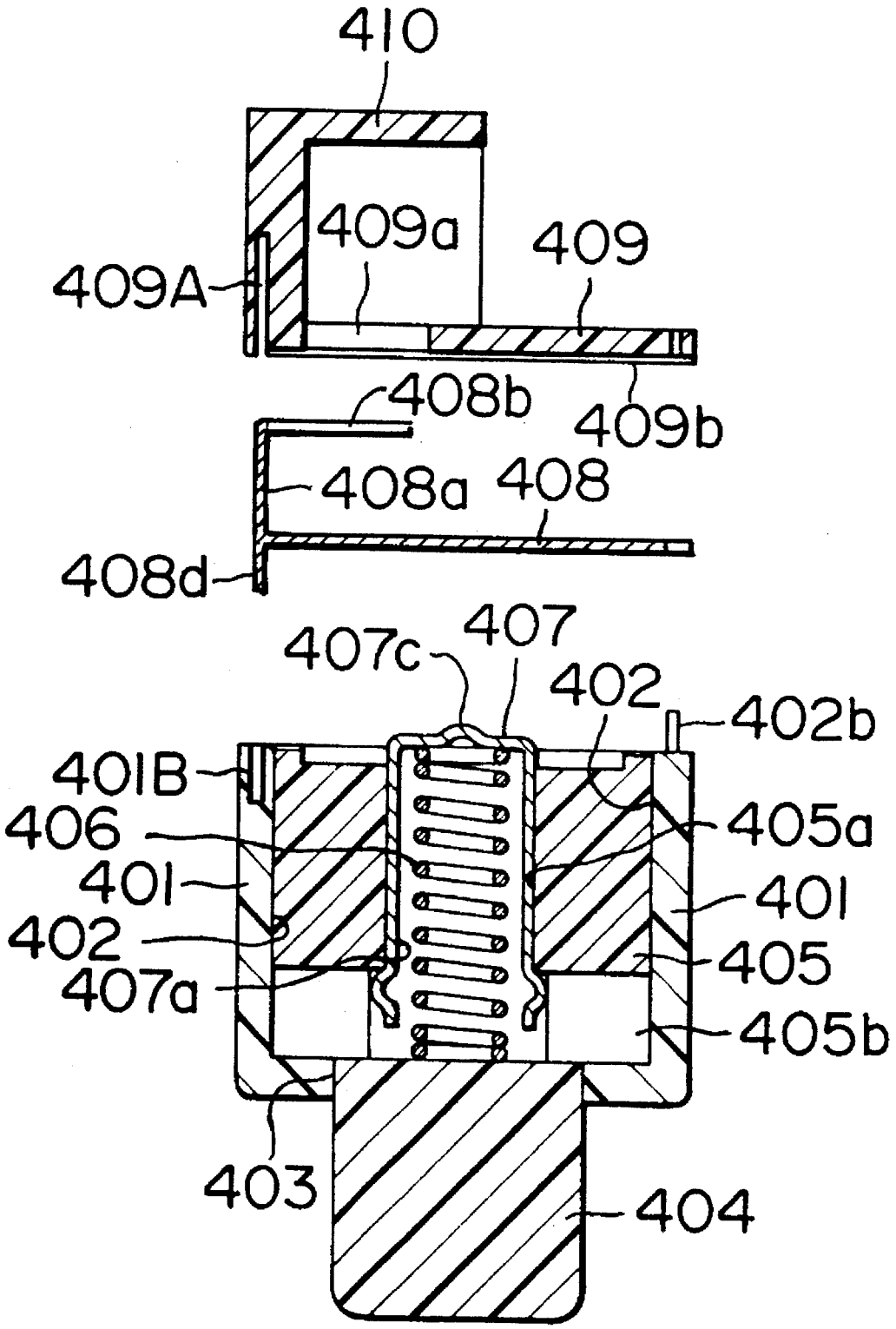

Another embodiment of the present invention is shown in accompanying FIG. 1D. As seen, the slide switch depicted therein includes a knob 404 which outwardly protrudes from the slot 403 as shown in FIG. 2D. Slot 403 communicates with recess 402 of insulating base 401 which is formed from a plastics material in the shape of a hollow rectangle. A sliding body 405, also made of a plastics material, is movably provided within recess 402 of the insulating base 401.

Movable contact 407 has a pair of temporary locking legs 407*a* and is resiliently provided within recess 405*a* as shown in FIG. 2D. The movable contact 407 is exposed at the outer surface of the sliding body 405 and is urged outwardly by means of resilient coil spring 406. A plurality of fixed contacts 408, made from metal strips, will therefore make sliding contact with the outer surface of the movable contact 407. The fixed contacts 408 are arranged in parallel as shown in FIG. 4D by means of positioning grooves 402*a* and pins 402*b* provided on the upper edge of the insulating base recess 402. The slide switch can then be constructed by covering its outer surface with insulating plate 409 which is fastened with screws in screw holes n to base 401 as shown in FIGS. 3D and 5D.

The back half of at least one, and preferably each, of the fixed contacts 108 is bent into a generally U-shape as shown in FIG. 1A. That is, the riser support pieces 108*a* and the forwardly extending plugs 108*b* are disposed in mutually perpendicular planes. Projections 408*d* are formed on the lower ends of the riser support pieces 408*a*. The fixed contacts 408 are temporarily fixed to the base 401 by tightly fitting the projections 408*d* into upper edge grooves 401 b of base 401 in opposition to the bias force of spring 406.

Figure 3D:
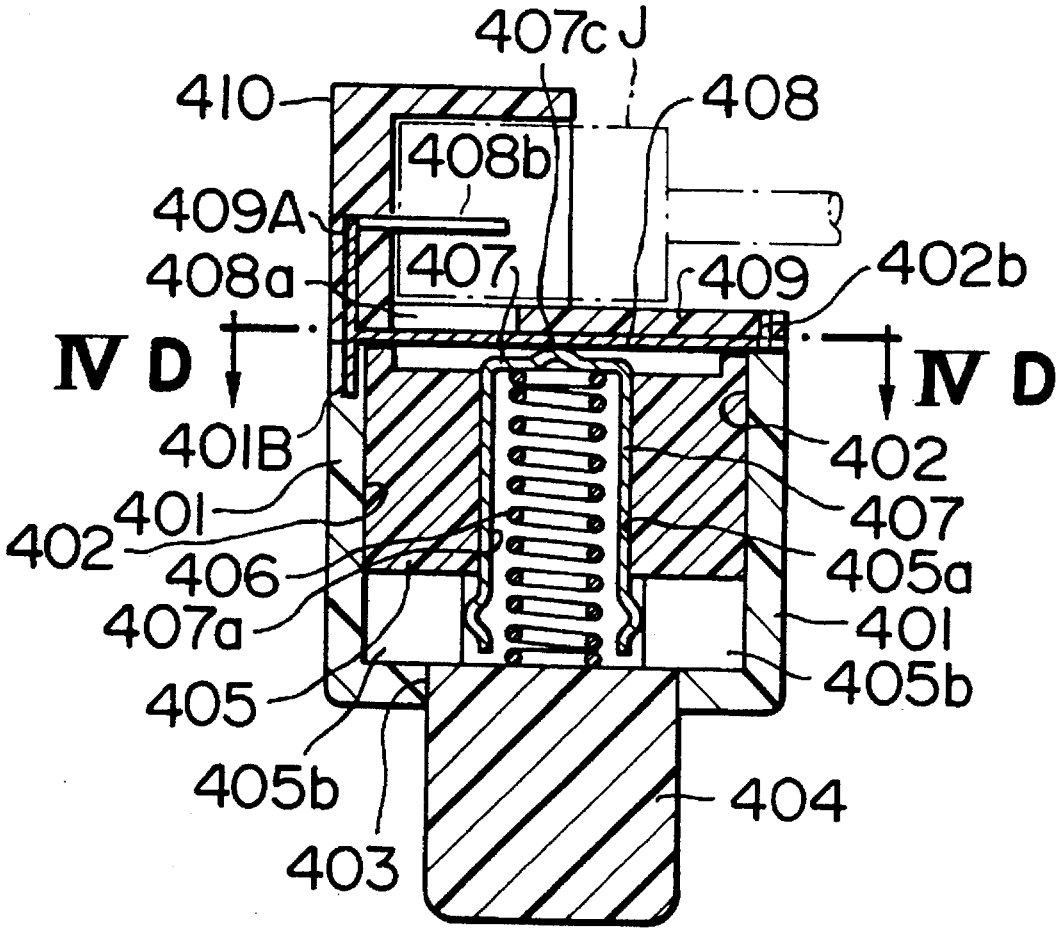
Figure 4D:
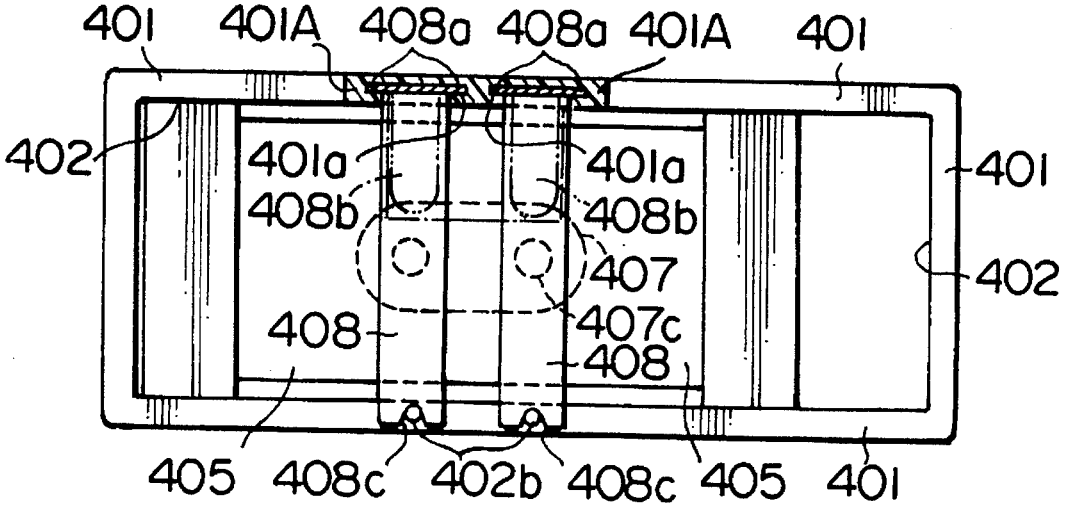
Figure 5D:
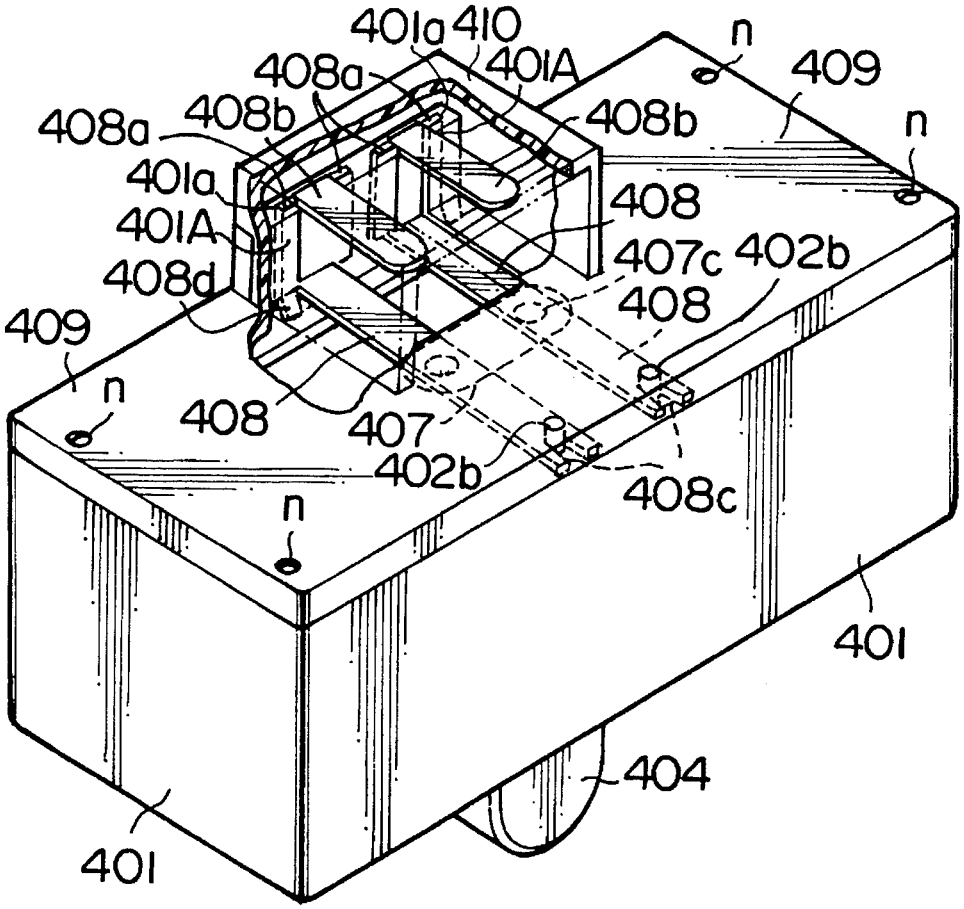

The back surfaces of riser support pieces 408*a* are supported with recess grooves 409*a* formed in plug cover 410 as shown in FIGS. 3D and 4D. The periphery of the plugs 408*b* is protected by the surrounding plug cover 410 which is integrally formed with insulating plate 409 as shown in FIGS. 3D and 5D. Accordingly, the slide switch according to this embodiment of present invention can be constructed wherein the riser support pieces 408*a* are securely clamped by recess grooves 409*a* formed in plug cover 410.

In addition, the position of each fixed contact 408 is restricted by inner grooves 409*b* of insulating plate 409. The insulating plate 409 can be attached to base 401 by any conventional fixing means, such as by hooking resilient tab 409*c* (shown in broken line in FIG. 1D) on the upper edge of side wall recess 401*b* of base 401.

Figure 6D:
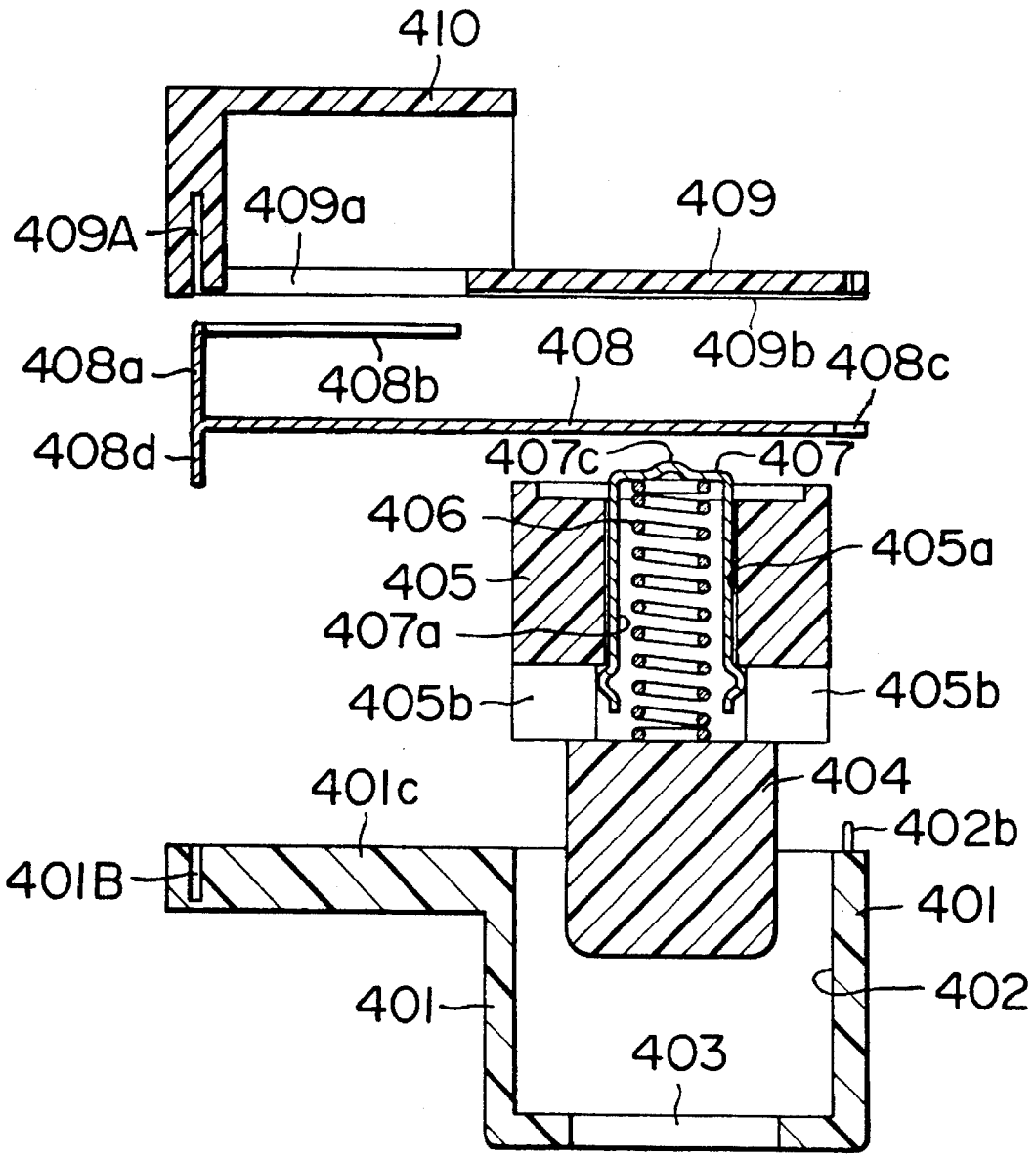
Figure 6E:
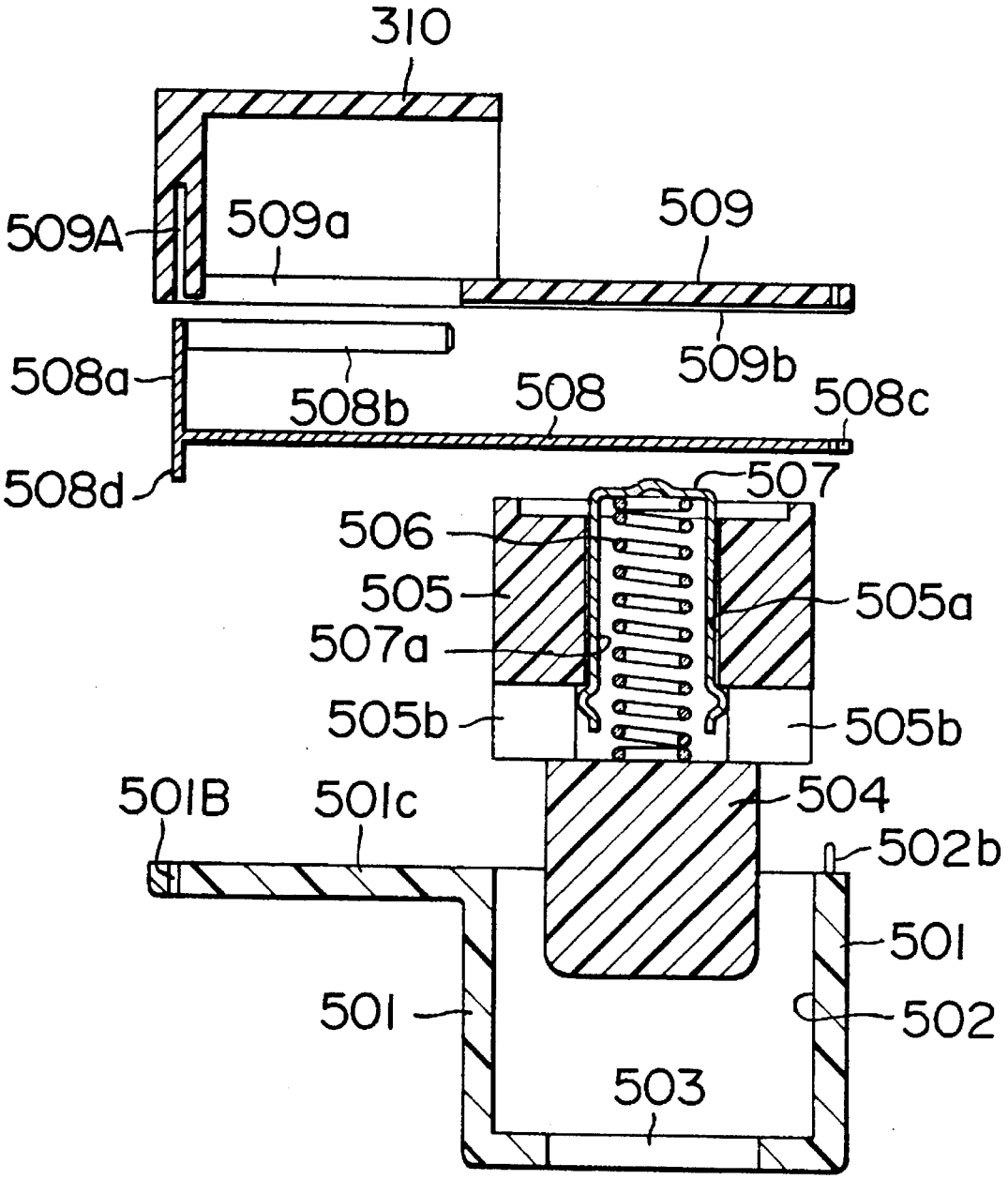
Figure 7D:
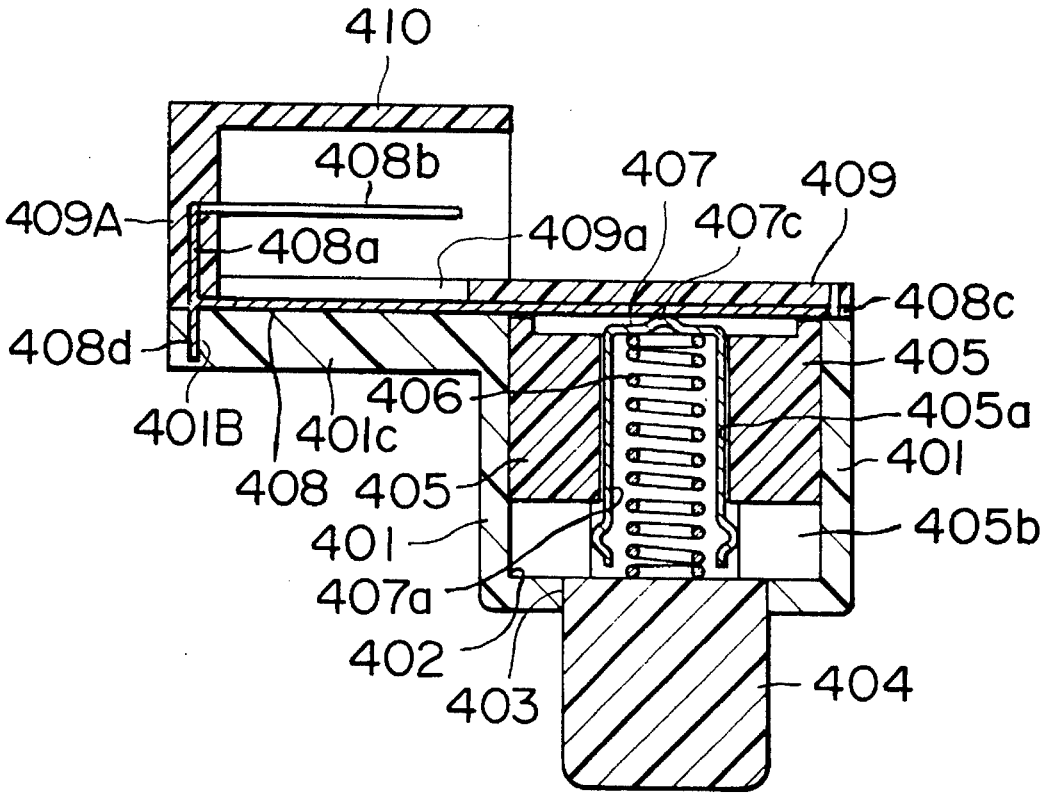
Figure 7E:
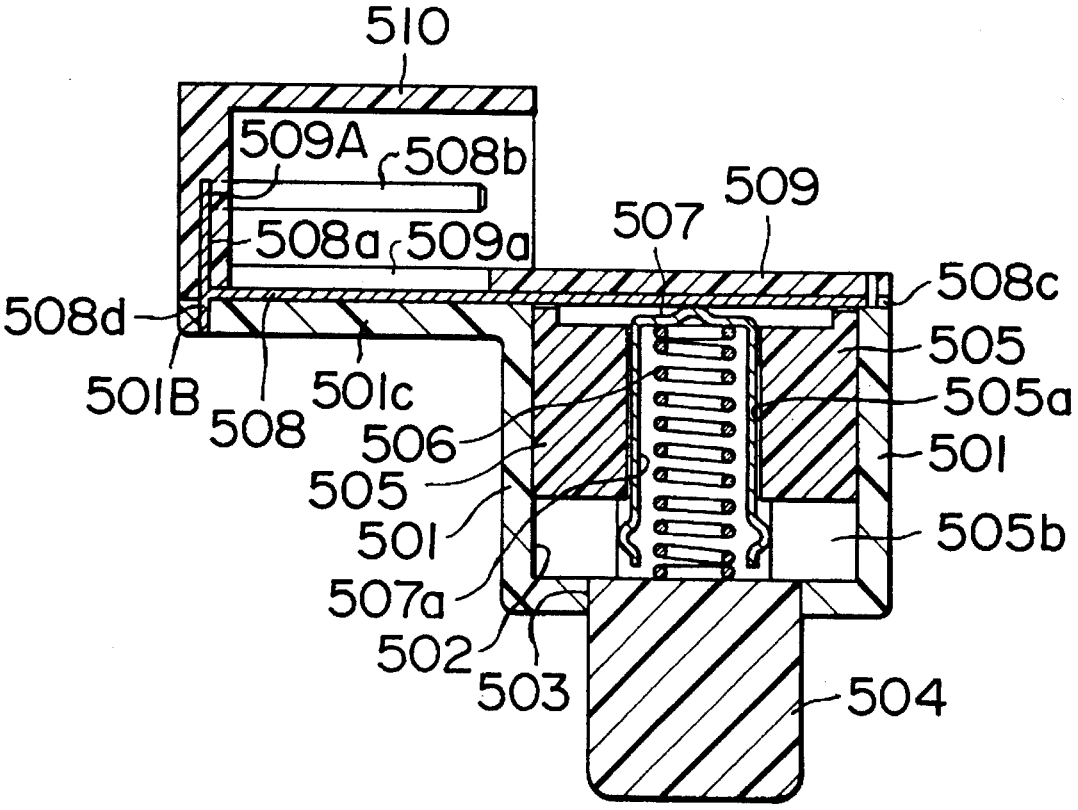

In order to conceal the entire outer surface of fixed contacts 408 with insulating plate 409, an overhang 401*c* is provided which protrudes from the side of insulating base 401 as shown in FIGS. 6D and 7D. The vicinity of the U-shaped riser portions 408*a* of fixed contacts 408 is placed at this overhang portion 401*c*. By then covering insulating plate 409, which has a slightly larger width, over the top of fixed contacts 408 as shown in FIG. 7D, the entire outer surface of fixed contacts 408 can be protected as a result of being concealed by insulating plate 409.

Figure 1E:
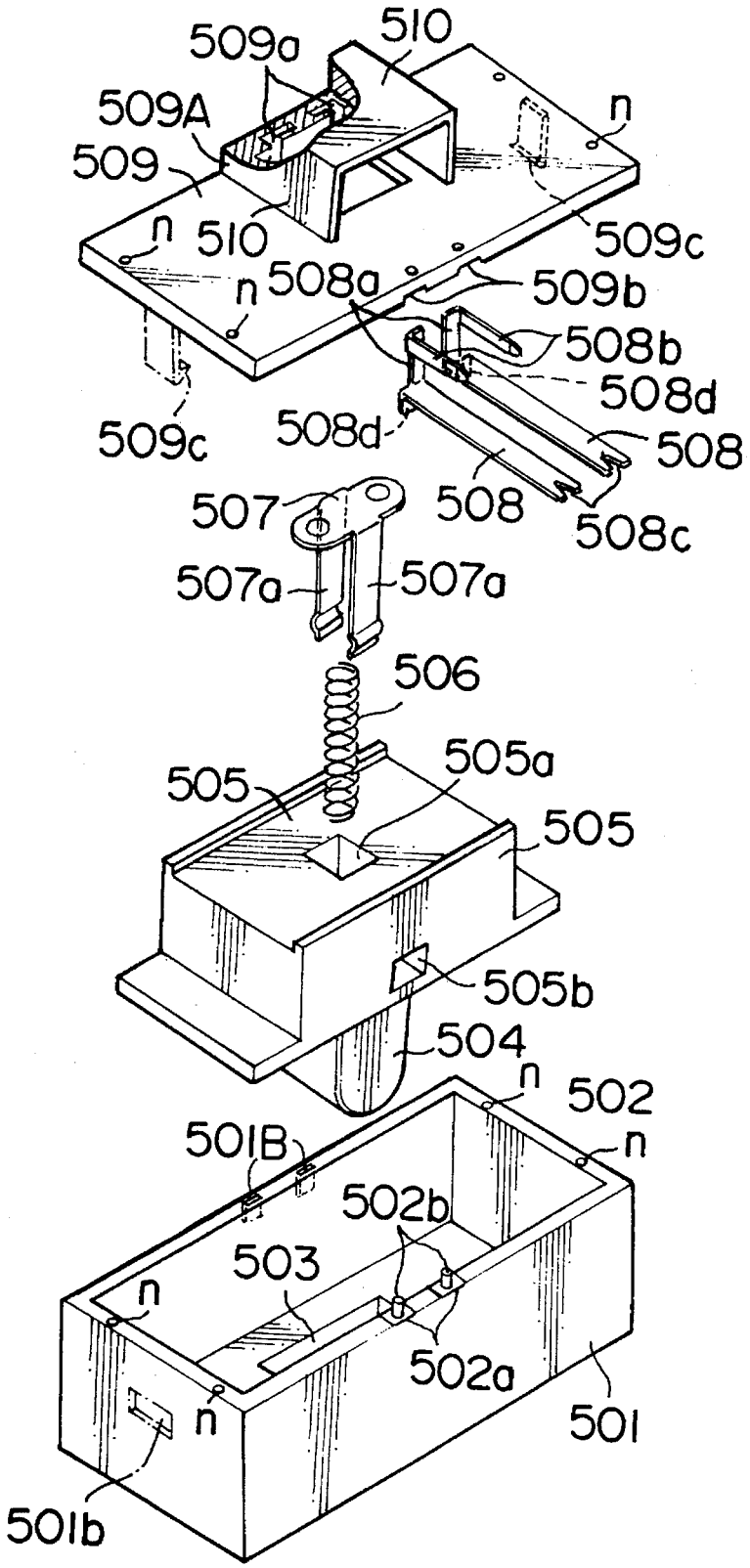
Figure 2E:
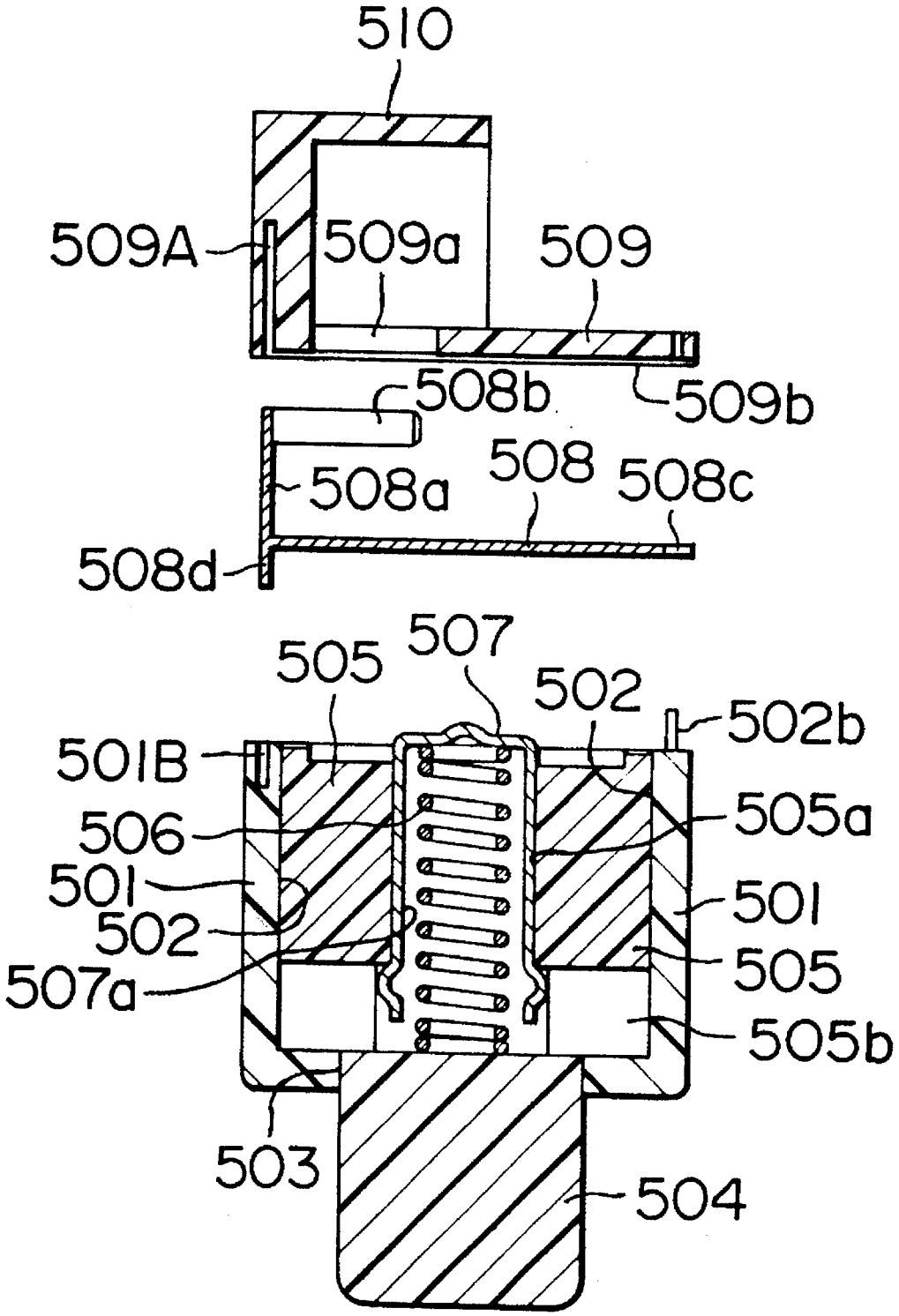

Another embodiment of the present invention is shown in accompanying FIG. 1E. As seen, the slide switch depicted therein includes a knob 504 which outwardly protrudes from the slot 503 as shown in FIG. 2E. Slot 503 communicates with recess 502 of insulating base 501 which is formed from a plastics material in the shape of a hollow rectangle. A sliding body 505, also made of a plastics material, is movably provided within recess 502 of the insulating base 501.

Movable contact 507 has a pair of temporary locking legs 507*a* and is resiliently provided within recess 505*a* as shown in FIG. 2E. The movable contact 507 is exposed at the outer surface of the sliding body 505 and is urged outwardly by means of resilient coil spring 506. A plurality of fixed contacts 308, made from metal strips, will therefore make sliding contact with the outer surface of the movable contact 507. The fixed contacts 508 are arranged in parallel as shown in FIG. 4E by means of positioning grooves 502*a* and pins 502*b* provided on the upper edge of the insulating base recess 502. The slide switch can then be constructed by covering its outer surface with insulating plate 509 which is fastened with screws in screw holes n to base 501 as shown in FIGS. 3E and 5E.

According to the present invention, the back half of at least one, and preferably each of the fixed contacts 508, is bent into a general L-shape as shown in FIG. 1E to form riser support pieces 508*a* and plugs 508*b*. That is, the riser support pieces 508*a* and the plugs 508*b* are disposed in mutually perpendicular planes. The plugs 508*b* extend towards the front and are oriented vertically as viewed from the front resulting in a form that is not inadvertently bent vertically. Projections 508*d* are formed on the lower ends of rising support pieces 508*a*. The fixed contacts 508 are temporarily fixed by tightly fitting the projections 508*d* into upper edge grooves 501*b* of base 501 in opposition to resilient spring 506.

Figure 3E:
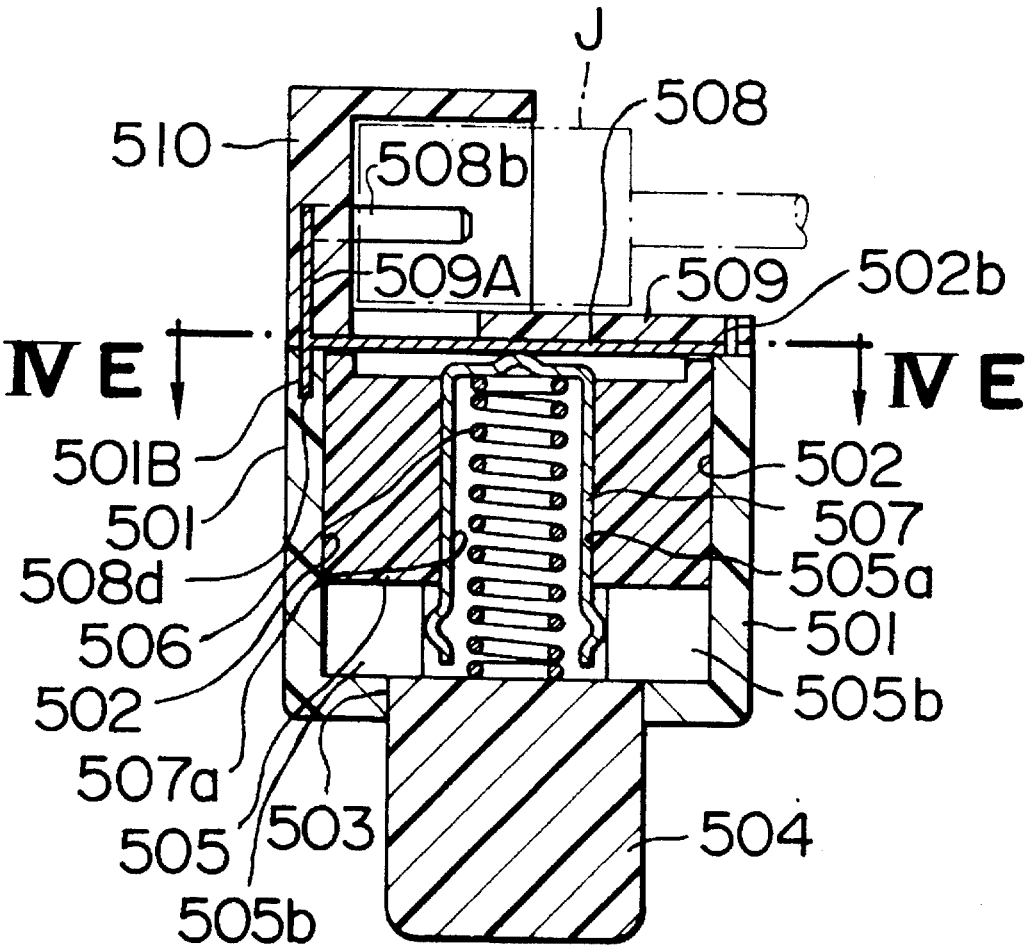
Figure 4E:
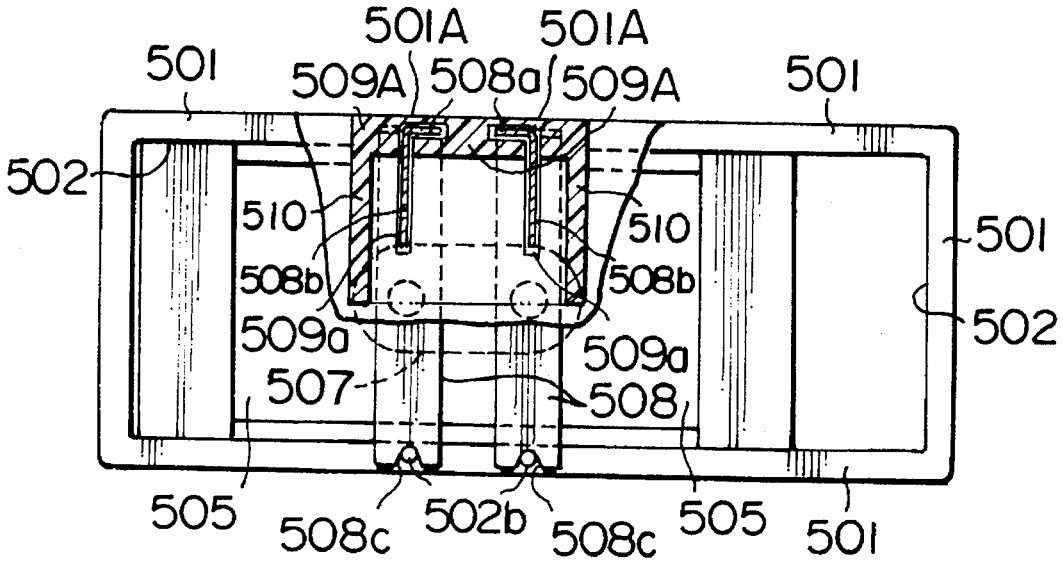
Figure 5E:
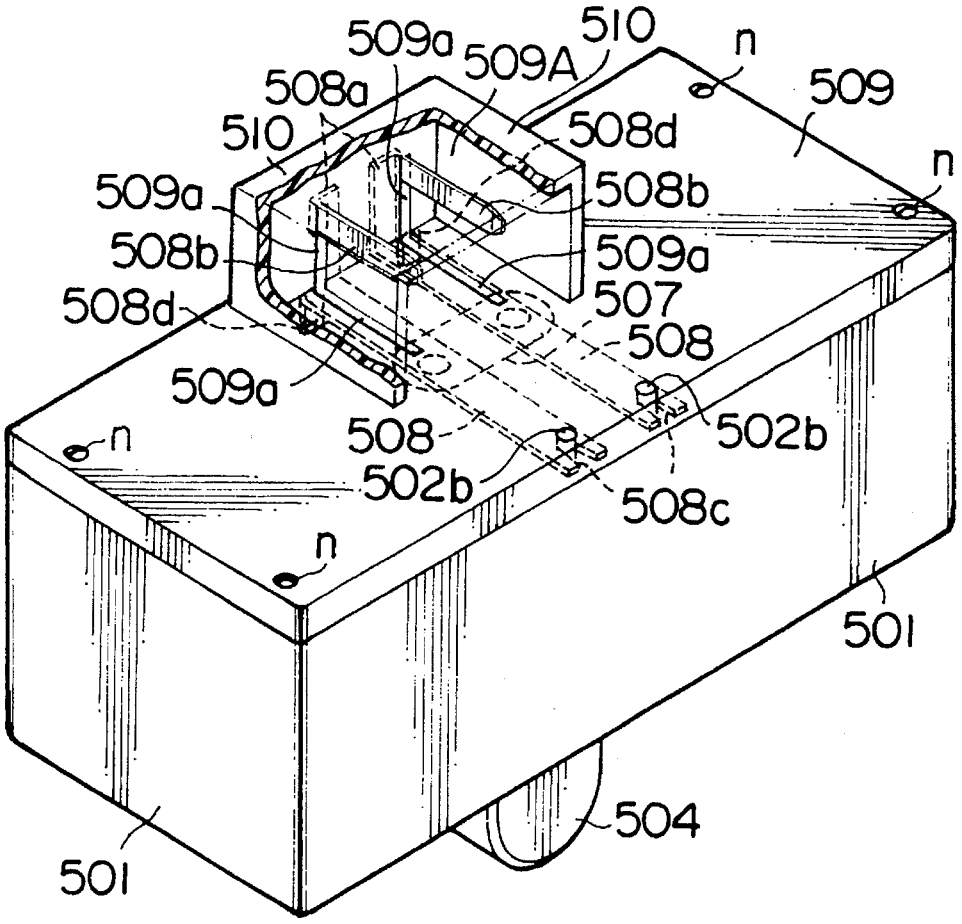

The back surfaces of riser support pieces 508*a* are supported within recess grooves 509*a* formed in plug cover 510 as shown in FIGS. 3E and 4E. The periphery of the plugs 508*b* is protected by plug cover 510 formed as an integral structure with insulating plate 509 as shown in FIGS. 3E and 5E. Accordingly, the slide switch according to this embodiment of the present invention can be constructed by securely clamping the riser support pieces 508*a* by recess grooves 509*a* formed in plug cover 510.

Another embodiment of this invention is shown in FIGS. 13–16, the basic structure of which includes a movable conductor 107*a*, such as a steel ball, within recess 105*a* opened in the outer surface of sliding body 105 via resilient coil spring 106. A plurality of fixed contacts 108, made of metal strips that straddle the outer surface of the movable conductor 107A, are arranged in parallel by means of positioning grooves 102*a* and pins 102*b* provided on the upper edge of the insulating base recess 102. The fixed contacts 108 are covered with the insulating plate 109, which is fastened with screws in screw holes n to base 101. The movable conductor 107A, such as a steel ball, is therefore made to drop into the gap between two fixed contacts 108 so as to establish continuity therebetween.

The switch may thus be turned on by making movable conductor 107A fall into the gap between two fixed conductors 108. Thus, a gap is naturally formed in which movable conductor 107A falls between two fixed contacts 108 without forming curved projections 108A in fixed contacts 108.

A modified embodiment of the slide switch according to the present invention is shown in FIGS. 18 through 27. According to this embodiment, the insertion direction of the plug-in jack may be set as desired by changing the bending pattern of fixed contacts 608, and providing a matching plug cover.

The present invention offers the following advantages. In this regard, the fixed contacts 108 and plugs 108*b* are respectively positioned and fixed by inserting riser support pieces 108*a* into base projecting piece grooves 101*a*. Moreover, fixed contacts 108 can be oriented by inner grooves 109*a* of the insulating plate 109 or by upper edge grooves 102*a* of base recess 102. In addition, plugs 108*b* can be protected with a plug cover.

Thus, since there is no inadvertent movement of fixed contacts 108 by an external disturbance, such as sliding friction caused by movable contact 107, the plugs 108*b* do not become loose during insertion and removal of a separately provided plug-in jack. As a result, consistent contact may be maintained for a prolonged time period. Furthermore, the fixed contacts 108 can be connected in a single operation to another location via jack J, thereby improving ease of use and enabling assembly wherein all members are aligned from a single direction. Thus, the present invention offers numerous advantages including being able to promote automated production and enabling high-quality and uniform products to be supplied with stability and in large volume.

Since riser support pieces 108*a* are provided by bending fixed contacts 108 into a general U-shape and extend to the side of base recess 102, the present invention offers the additional advantage of being able to protect fixed contacts 108 (including the entire outer surfaces of fixed contacts 108) by concealing the entirety of base recess 102 with insulating plate 109. The present invention offers the additional advantage of being able to fix insulating plate 109 to insulating base 101 in a single operation without using screws.

With regard to riser support pieces 208*a* and plugs 208*b*, the present invention offers the advantage that the plugs 208*b* are not inadvertently bent or warped due to insertion and removal of the jack or by external disturbances. Moreover, since the bases of plugs 208*b* can be positioned by the edges of vertical grooves 210*a* of guide piece 210 for guiding insertion of plug-in jack J (FIG. 3B) while also being able to reinforce the plugs 208*b* in their thickness direction, the present invention offers the advantage of being able to improve electrical reliability.

Moreover, since fixed contacts 208 themselves are embedded in fixed contact positioning grooves provided in base projecting pieces 202 and in the opposing surfaces of base 201 or insulating plate 209, and are rigidly positioned by screws or like means, there is no inadvertent movement of fixed contacts 208 by an external disturbance such as sliding friction caused by movable contact 207. Thus, the present invention offers another advantage of enabling insertion and removal to be performed favorably at all times while also being able to maintain electrical contact.

Fixed contacts 308 and plugs 308*b* are respectively and securely positioned and fixed by clamping riser support pieces 308*a* between base projecting piece 301A and projecting piece 309A of insulating plate 309 fixed by covering the edge of the opening of base 301. Moreover, fixed contacts 308 can be oriented by inner surface grooves 309*a* of the switch cover in the form of insulating plate 309 or upper edge grooves 302*a* of base recess 302. In addition, plugs 308*b* can be protected with a plug cover. Thus, since there is no inadvertent movement of fixed contacts 308 by an external disturbance such as sliding friction caused by movable contact 307, and plugs 308*b* do not become loose during insertion and removal of a separately provided plug-in jack. As a result, reliable contact may be maintained for a long time. Also, the fixed contacts 308 can be connected in a single operation to another location via jack J, thereby improving ease of use and enabling assembly wherein all members are aligned from a single direction. Thus, the present invention offers numerous advantages including being able to promote automated production and enabling high-quality and uniform products to be supplied with stability and in large volume.

In the case of the other embodiments of the present invention, since riser support pieces 408*a* and 508*a* of bent fixed contacts 408 and 508 are supported by clamping grooves 409A and 509A formed in the plug cover, the structure of base 401 is able to be simplified. In addition, lower projections 408*d* and 508*d* are provided on fixed contacts 408 and 508, and grooves 401B and 501 B, into which the lower projections 408*d* and 508*d* are tightly fit, are provided on the upper edge of the base. Since fixed contacts 408 and 508 are able to be temporarily fixed by fitting the lower projections 408*d* and 508*d* into upper edge grooves 401B and 501B in opposition to resilient springs 406 and 506, the present invention offers the advantage of making assembly of the slide switch easier.

In the case of the fixed contacts 108 and plugs 108*b*, it can be noted that they are respectively reinforced by firmly positioning riser support pieces 108*a* by engaging the wide portions of the riser support pieces 108*a* in side grooves 101*a* formed in base projecting piece 101A. Moreover, fixed contacts 108 can be embedded either in fixed contact embedding grooves 109*b* in the inner surface of the insulating plate 109, or in upper edge grooves 102*a* of base recess 102, or by other orienting means.

Thus, since there is no inadvertent movement of fixed contacts 108 by an external disturbance such as sliding friction caused by movable contact 107 (e.g., a steel ball), and fixed contacts 108, the plugs 108*b* are not inadvertently moved during insertion and removal of a separately provided plug-in jack or the like. As a result, the present invention offers the advantage of being able to maintain good contact and operation during jack insertion and removal for a long time. In particular, since movable conductor 107A is in the form of a ball, it will resiliently fall into the gap between each fixed contact 108 integrated into a single narrow conducting strip, as well as the gap between curved projections 108A. Thus, the operation of the knob as a slide switch is provided with a "clicking" or "snapping" action. Thus, the present invention also offers the advantage of improved precision of control as a switch.

What is claimed is:

1. A slide switch comprising:

an electrically insulating housing defining a recess and an elongate slot which opens into said recess;

a slide body received within said recess of said housing so as to be slidably movable therewithin between at least first and second positions, wherein said slide body includes (i) a knob which protrudes outwardly from said housing through said defined slot so as to be moved manually from one end of the slot to another end and thereby slidably move the slide body between said at least first and second positions, and (ii) a movable electrical contact which is movable with said slide body between said at least first and second positions thereof;

a plurality of parallel fixed contacts extending substantially transverse to said slot such that said movable electrical contact of said slide body makes electrical contact with at least one of said fixed contacts when said slide body is moved into at least one of said first and second positions;

an electrically insulating cover plate attached to said housing in covering relationship to said recess so as to thereby cover said slide body and said fixed contacts;

said cover plate integrally including an open ended guide housing member which defines an interior space;

at least one of said fixed contacts having an end bent to form a contact plug which projects into said interior space of said guide housing member so as to be connectable to a plug-in jack inserted into said open end of said housing member.

2. The slide switch of claim 1, wherein said end of said at least one fixed contact establishes a riser support piece joining said contact plug to said fixed contact.

3. The slide switch of claim 1, wherein said end of said at least one fixed contact is generally U-shaped and establishes a riser support piece joining said contact plug to said fixed contact.

4. The slide switch of claim 2 or 3, wherein at least one of said housing and said cover plate includes a groove for receiving and supporting said riser support piece.

5. The slide switch of claim 1, wherein said cover plate includes a resilient tab, and said housing includes a side wall recess which receives said tab of said cover plate so as to secure said cover plate to said housing.

6. The slide switch as in claim 2 or 3, wherein said riser support piece and said contact plug of said at least one fixed contact are disposed in mutually perpendicular planes such that said contact plug is disposed within said interior space substantially parallel to said at lest one fixed contact.

7. The slide switch of claim 6, wherein said guide housing member has a pair of opposed open ends, wherein said contact plug is inserted into one of said open ends so as to project toward the other open end thereof within said interior space.

8. The slide switch as in claim 2 or 3, wherein said riser support piece and said contact plug of said at least one fixed contact are coplanar.

9. The slide switch of claim 8, wherein said cover plate includes a resilient tab, and said housing includes a side wall recess which receives said tab of said cover plate so as to secure said cover plate to said housing.

10. The slide switch of claim 8, wherein said guide housing member includes an end wall opposed to said open end, and wherein said end wall includes a groove through which said contact plug projects into said interior space.

11. The slide switch of claim 10, wherein said groove extends to a portion of said cover plate.

12. The slide switch of claim 4, wherein an upper edge of said housing includes said groove, and wherein said at least one fixed contact includes a lower projection which is received within said groove.

13. The slide switch of claim 12, wherein said movable contact includes a spring for urging said movable contact into engagement with said fixed contacts, and wherein said lower projection received within said groove positionally holds said at least one fixed contact in opposition to said spring.

14. The slide switch of claim 2 or 3, wherein an upper edge of said housing includes a groove, and wherein said at least one fixed contact includes a lower projection which is received within said groove.

15. The slide switch of claim 14, wherein said movable contact includes a spring for urging said movable contact into engagement with said fixed contacts, and wherein said lower projection received within said groove positionally holds said at least one fixed contact in opposition to said spring.

* * * * *